US009022807B2

(12) United States Patent
Uno et al.

(10) Patent No.: US 9,022,807 B2
(45) Date of Patent: May 5, 2015

(54) CONNECTOR HAVING A WIRE SHIELD MEMBER FASTENED TO A SHIELD SHELL COVERING A RESIN PART MOLDED OVER AN L-SHAPED TERMINAL FITTING

(75) Inventors: Masafumi Uno, Yokkaichi (JP); Tomoyuki Sakata, Yokkaichi (JP); Tomokazu Kashiwada, Yokkaichi (JP)

(73) Assignees: Autonetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 6 days.

(21) Appl. No.: 14/004,572

(22) PCT Filed: Mar. 16, 2012

(86) PCT No.: PCT/JP2012/056835

§ 371 (c)(1),
(2), (4) Date: Sep. 11, 2013

(87) PCT Pub. No.: WO2012/124801

PCT Pub. Date: Sep. 20, 2012

(65) Prior Publication Data

US 2014/0004740 A1 Jan. 2, 2014

(30) Foreign Application Priority Data

Mar. 17, 2011 (JP) ..... 2011-059447

(51) Int. Cl.
*H01R 9/03* (2006.01)
*H01R 13/512* (2006.01)
(Continued)

(52) U.S. Cl.
CPC ..... *H01R 13/648* (2013.01); *H01R 13/6592* (2013.01); *H01R 13/6596* (2013.01); *H01R 24/38* (2013.01)

(58) Field of Classification Search
CPC ..... H01R 13/502–13/512; H01R 13/658; H01R 23/025; H01R 23/7073
USPC ..... 439/607.44, 607.45, 607.48, 607.55, 439/607.58
See application file for complete search history.

(56) References Cited

U.S. PATENT DOCUMENTS 5,466,175 A * 11/1995 Onoda ..... 439/607.48
7,059,918 B2 * 6/2006 Matsumoto et al. ..... 439/752
(Continued)

FOREIGN PATENT DOCUMENTS

JP 6-295769 10/1994
JP 2003-297472 10/2003
(Continued)

OTHER PUBLICATIONS

International Search Report of May 17, 2012.

*Primary Examiner* — Chandrika Prasad
(74) *Attorney, Agent, or Firm* — Gerald E. Hespos; Michael J. Porco; Matthew T. Hespos

(57) ABSTRACT

A connector (130) is provided with wires (12) including shield layers (12C), L-shaped terminal fittings (13) mounted on ends of the wires (12), a resin molded part (24) provided to include connected parts of the wires (12) and the terminal fittings (13), a first shield shell (133) configured to cover a predetermined part of the resin molded part (24) and including a through hole (33A), a wire shield connecting member (132) connected to the shield layers (12C) of the wires (12) and including a through hole (23A) and a bolt (40) configured to fasten the first shield shell (133) and the wire shield connecting member (132) by being inserted through the respective through holes (33A, 23A) and electrically connect the first shield shell (133) and the wire shield connecting member (132).

9 Claims, 39 Drawing Sheets

(51) Int. Cl.

| | |
|---|---|
| ***H01R 13/648*** | (2006.01) |
| ***H01R 13/6592*** | (2011.01) |
| ***H01R 13/6596*** | (2011.01) |
| *H01R 24/38* | (2011.01) |

(56) References Cited

U.S. PATENT DOCUMENTS

| | | | | |
|---|---|---|---|---|
| 8,840,428 | B2 * | 9/2014 | Omae et al. | 439/582 |
| 2012/0122341 | A1 * | 5/2012 | Okamoto | 439/607.55 |
| 2012/0315790 | A1 * | 12/2012 | Hein et al. | 439/574 |
| 2013/0189879 | A1 * | 7/2013 | Kondo | 439/607.44 |
| 2014/0148034 | A1 * | 5/2014 | Kashiwada et al. | 439/345 |
| 2014/0148045 | A1 * | 5/2014 | Kashiwada et al. | 439/485 |

FOREIGN PATENT DOCUMENTS

| | | |
|---|---|---|
| JP | 2004-119047 | 4/2004 |
| JP | 2010-272404 | 12/2010 |

* cited by examiner

CONNECTOR HAVING A WIRE SHIELD MEMBER FASTENED TO A SHIELD SHELL COVERING A RESIN PART MOLDED OVER AN L-SHAPED TERMINAL FITTING

BACKGROUND

1. Field of the Invention

The present invention relates to a connector.

2. Description of the Related Art

Conventionally, a connector disclosed in Japanese Unexamined Patent Publication No. 2003-297472 is known as a configuration for mounting a shielded wire to a device.

The connector of Japanese Unexamined Patent Publication No. 2003-297472 is molded with a shield layer of a shielded wire, on an end of which an I-shaped terminal fitting extending in the same direction as an extending direction of the wire is mounted, connected to a bracket (connecting member) made of metal via a sleeve. The connector is mounted by mounting the bracket on a shield case of a device.

Although the terminal fitting has an I-shape extending in the same direction as the extending direction of the wire in patent literature 1, a case is also conceivable where it is desired to use an L-shaped terminal fitting extending in a direction perpendicular to the extending direction of the wire. In this case, if the above bracket is used, shielding cannot be performed only by the bracket since a molded area is larger on the terminal fitting side than on the bracket side and the configuration of the connector may become complicated to shield this part.

The present invention was completed based on the above situation and an object thereof is to provide a connector capable of performing a shielding function by a simple configuration.

SUMMARY OF THE INVENTION

The present invention is directed to a connector, including a wire with a shield layer; an L-shaped terminal fitting to be mounted on an end of the wire; a resin molded part provided to include a connected part of the wire and the terminal fitting; a first shield shell configured to cover a predetermined part of the resin molded part and including a through hole; a wire shield connecting member to be connected to the shield layer of the wire and including a through hole; and a fastening member configured to fasten the first shield shell and the wire shield connecting member by being inserted through the respective through holes of the first shield shell and the wire shield connecting member and electrically connect the first shield shell and the wire shield connecting member.

According to this configuration, since the first shield shell covers the resin molded part, a shielding function can be achieved by a simple configuration.

Further, in electrically connecting the shield layer of the wire and the first shield shell, the wire shield connecting member to be connected to the shield layer is used and the first shield shell and the wire shield connecting member are fastened by the fastening member inserted through the respective through holes thereof. Thus, shields can be reliably connected by a simple configuration.

The first shield shell and the wire shield connecting member preferably are placed next to each other on a part not including the resin molding and include fastened portions formed with the respective through holes. Since the respective fastened portions arranged on the part not including the resin molding can be fastened by the fastening member in this way, a projecting distance of the fastening member in a thickness direction of the connector can be reduced and the thickness of the connector can be reduced.

The respective fastened portions preferably are fastening pieces extending from the first shield shell and the wire shield connecting member. Thus, the configurations of the fastened portions can be simplified.

The fastening pieces may extend toward a back surface side of the resin molded part. Since the first and third fastened portions are fastening pieces in this way, the configurations of the first and third fastened portions can be simplified.

The connector further preferably includes a second shield shell configured to cover a part of the resin molded part not covered by the first shield shell and including a through hole, the fastening member fastens the first shield shell, the second shield shell and the wire shield connecting member by being inserted through the respective through holes of the first shield shell, the second shield shell and the wire shield connecting member and electrically connects the first shield shell, the second shield shell and the wire shield connecting member. Since three shield members, i.e. the first shield shell, the second shield shell and the wire shield connecting member are fastened by the fastening member inserted through the respective through holes of the three members, the number of fastening by the fastening member can be reduced as compared with the case where two each of the members are fastened.

The second shield shell preferably includes a fastened portion to be arranged on a part not including the resin molding and the fastened portion is a fastening piece extending from the second shield shell. Thus, the projecting distance of the fastening member in the thickness direction of the connector can be reduced and the thickness of the connector can be reduced.

The first shield shell preferably covers a back surface side of the resin molding, the second shield shell covers a front surface side of the resin molding, and fastening by the fastening member is performed with the wire shield connecting member sandwiched between the first and second shield shells. Since the respective shield shells are separated at front and rear sides and can be easily mounted, the connector can be easily assembled.

The second shield shell preferably has a tubular shape surrounding a part of the resin molded part from which the wire extends, and the first shield shell covers a back surface side of the resin molded part not covered by the first shield shell. In this way, positioning in assembling the first and second shield shells can be facilitated as compared with the case where the first and second shield shells are separated at front and rear sides.

There preferably are a plurality of wires, the wire shield connecting member preferably includes a fastened portion to which the fastening member is to be fastened and a plurality of insertion portions through which the plurality of wires are to be inserted and which are to be connected to the shield layers, and the plurality of insertion portions and the fastened portion are connected. In this way, a configuration for connecting the shield layers of the wires to the shield shell can be simplified.

According to the present invention, it is possible to provide a connector capable of achieving a shielding function by a simple configuration.

DETAILED DESCRIPTION OF THE PREFERRED EMBODIMENTS

Hereinafter, a connector 10 according to a specific first embodiment of the present invention is described with reference to FIGS. 1 to 15.

Figure 1:
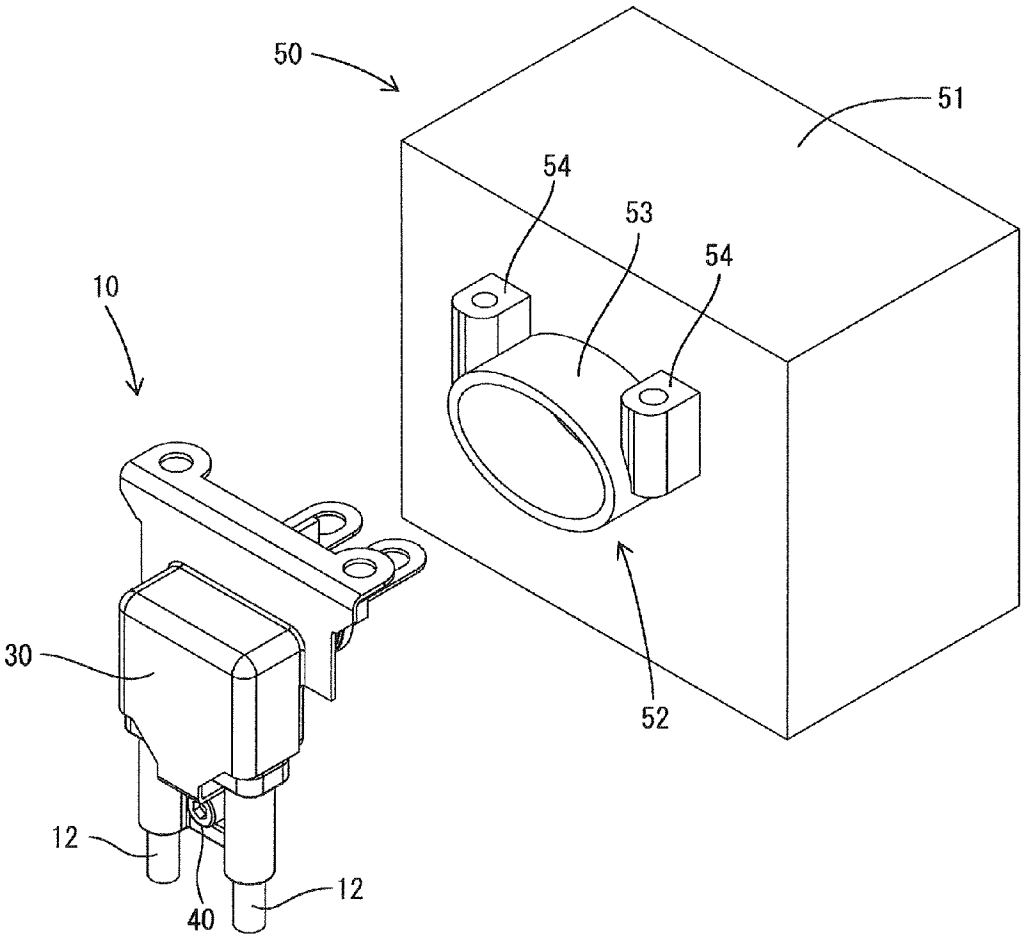
FIG. 1 is a view showing a state where a connector of a first embodiment is being mounted on a device.
Figure 2:
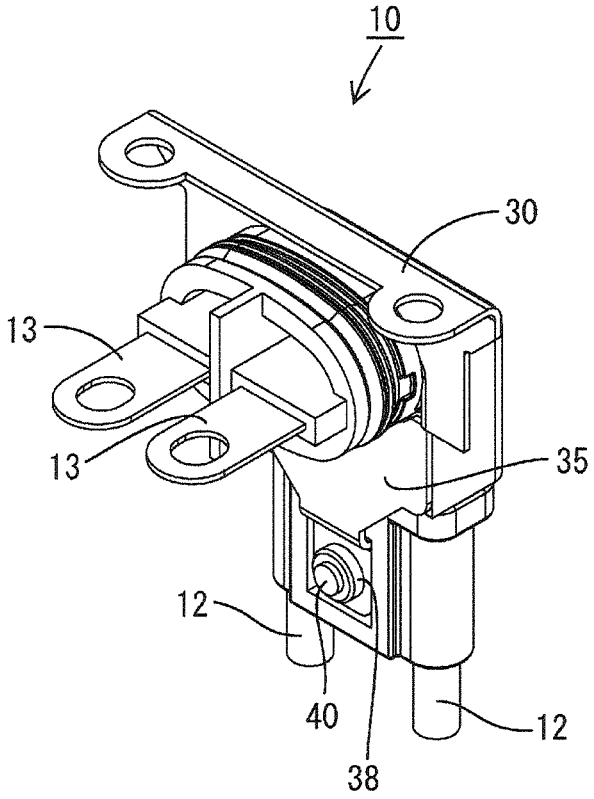
FIG. 2 is a perspective view showing the connector.
Figure 3:
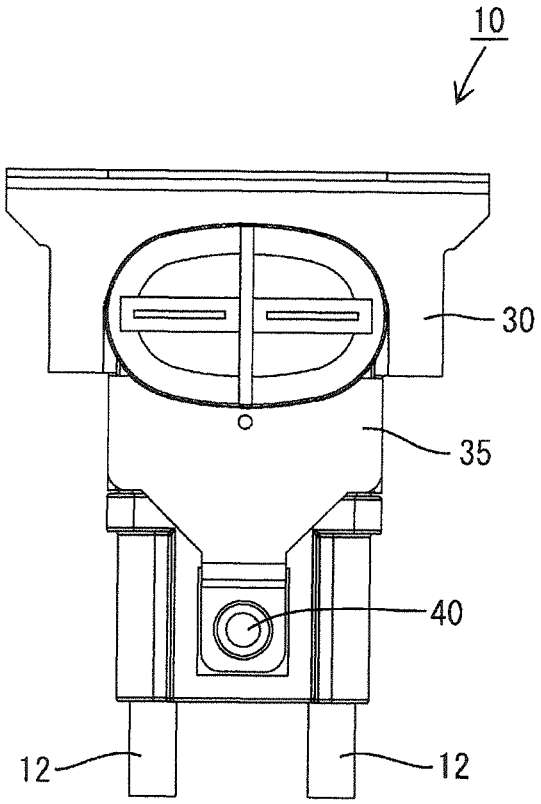
FIG. 3 is a front view showing the connector.
Figure 4:
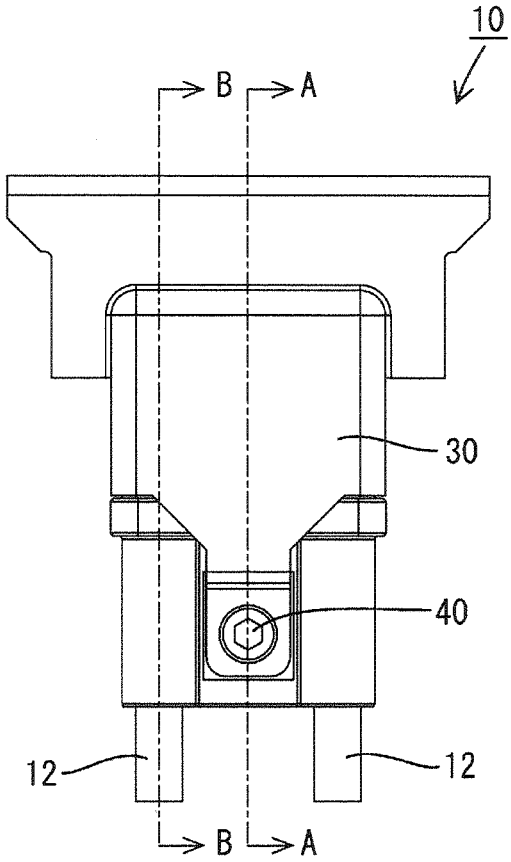
FIG. 4 is a rear view showing the connector.
Figure 5:
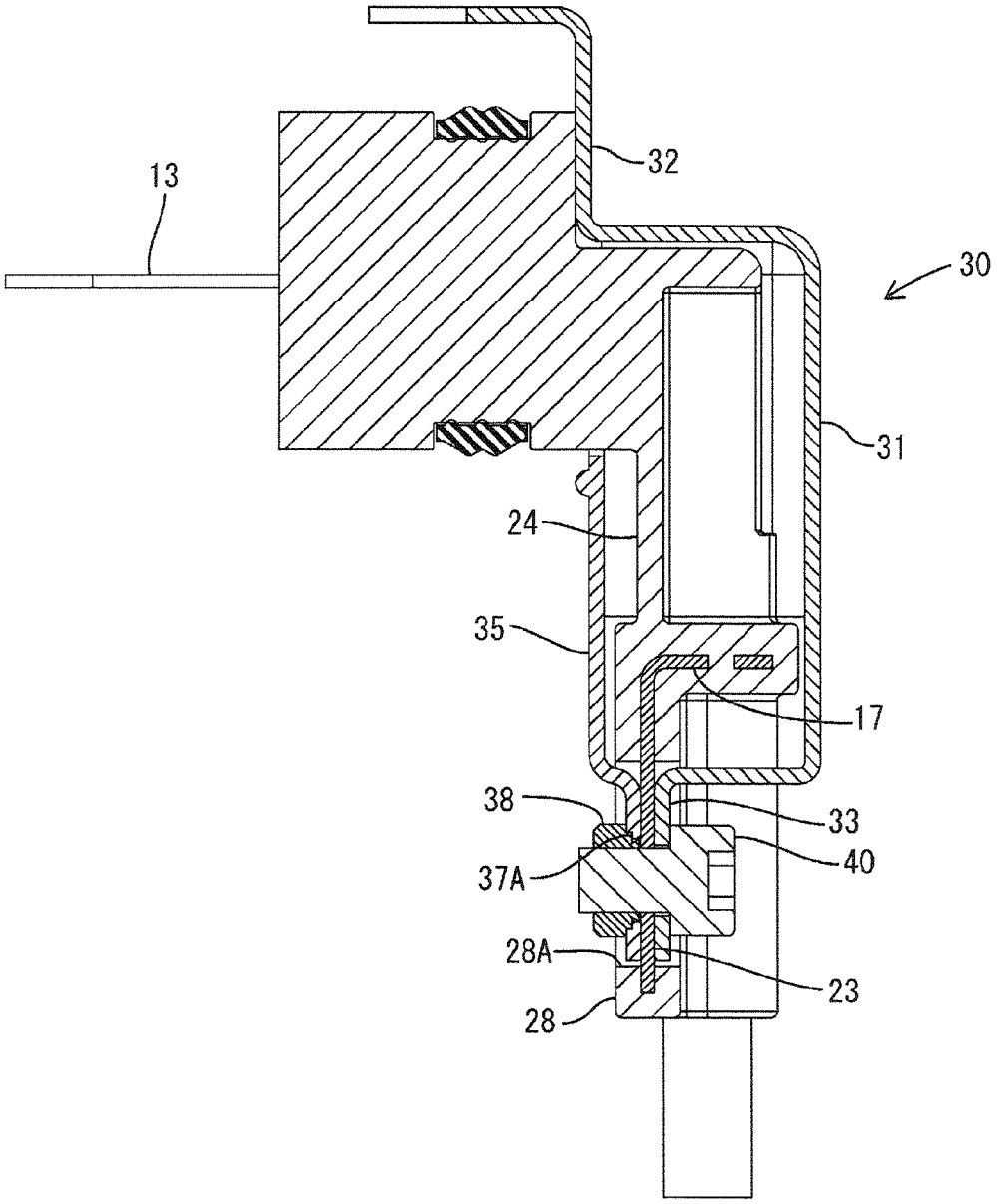
FIG. 5 is a section along A-A of FIG. 4.

As shown in FIG. 1, the connector 10 of this embodiment is to be mounted on a shield case 51 of a device 50 (e.g. inverter device or the like of a hybrid vehicle or an electric vehicle). Note that, in the following description, a vertical direction is based on FIG. 5 and left and right sides in FIG. 5 are respectively referred to as front and rear sides.

As shown in FIG. 1, the device 50 is such that a device main body (not shown) is accommodated in the shield case 51 made of an electrical conductive material, and a mounted portion 52 on which the connector 10 is to be mounted projects from the front surface of the shield case 51.

The mounted portion 52 is composed of a tubular projection 53 having an elliptical shape long in a lateral direction and tubularly projecting, and a pair of clamping portions 54 provided on opposite sides of the tubular projection 53 and each formed with a screw hole on an upper surface side.

Figure 7:
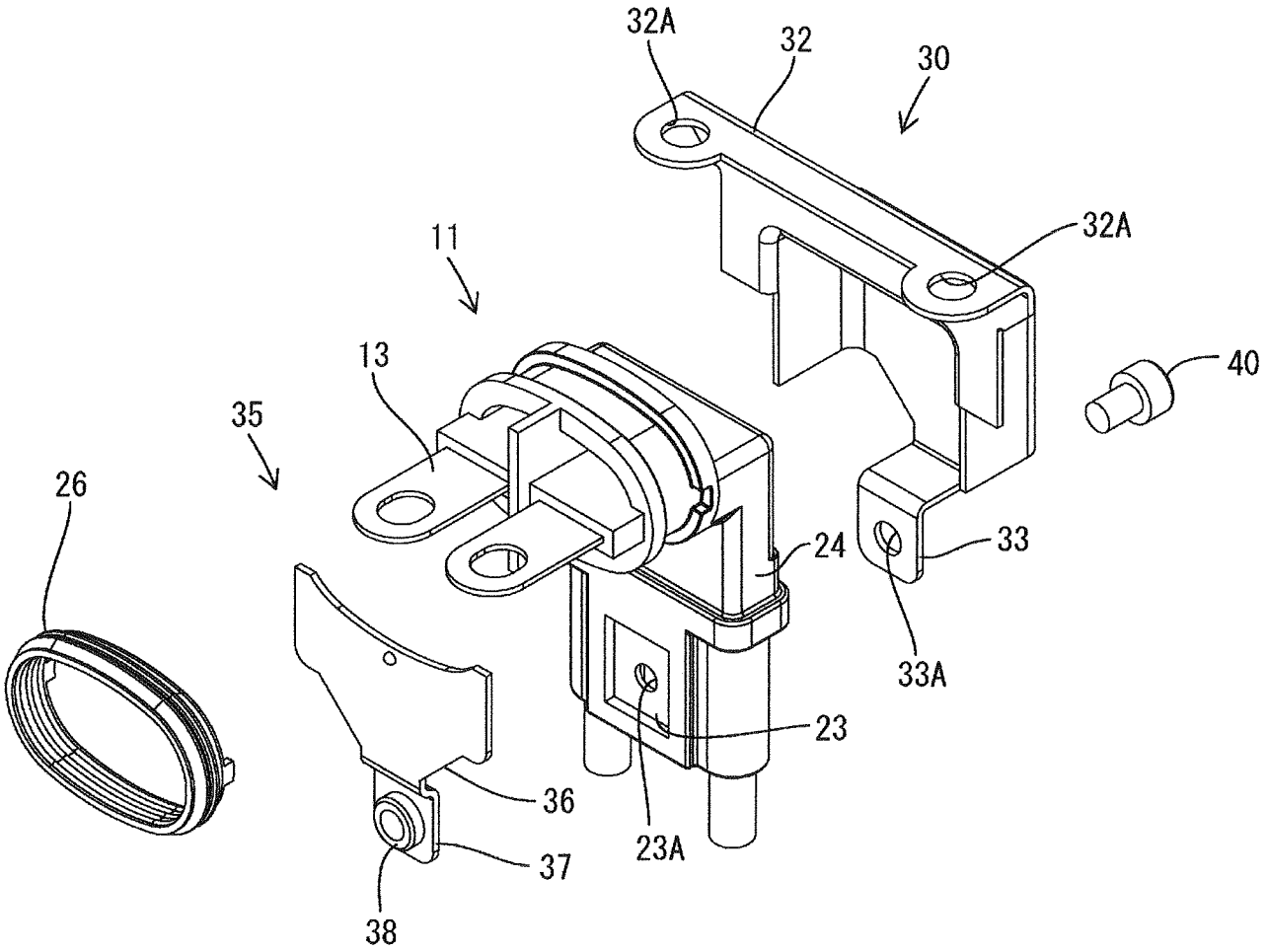
FIG. 7 is an exploded perspective view showing the connector.
Figure 8:
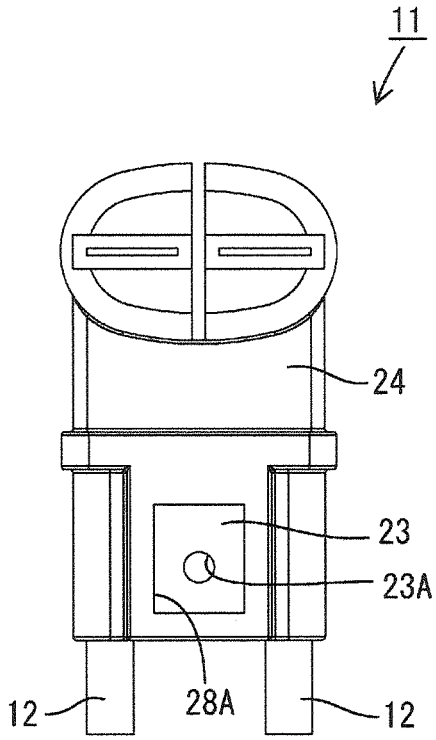
FIG. 8 is a front view showing the molded connector.
Figure 9:
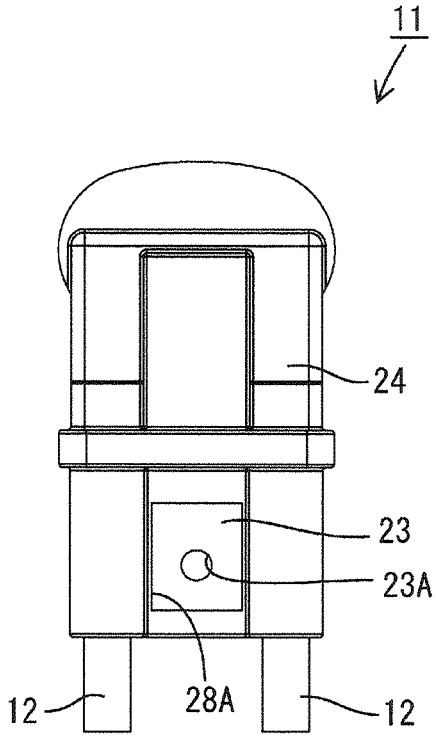
FIG. 9 is a rear view showing the molded connector.

As shown in FIG. 7, the connector 10 includes a molded connector main body 11, a first shield shell 30 for covering a back surface side of the molded connector main body 11 and a second shield shell 35 for covering a front surface side of the molded connector main body 11.

Figure 10:
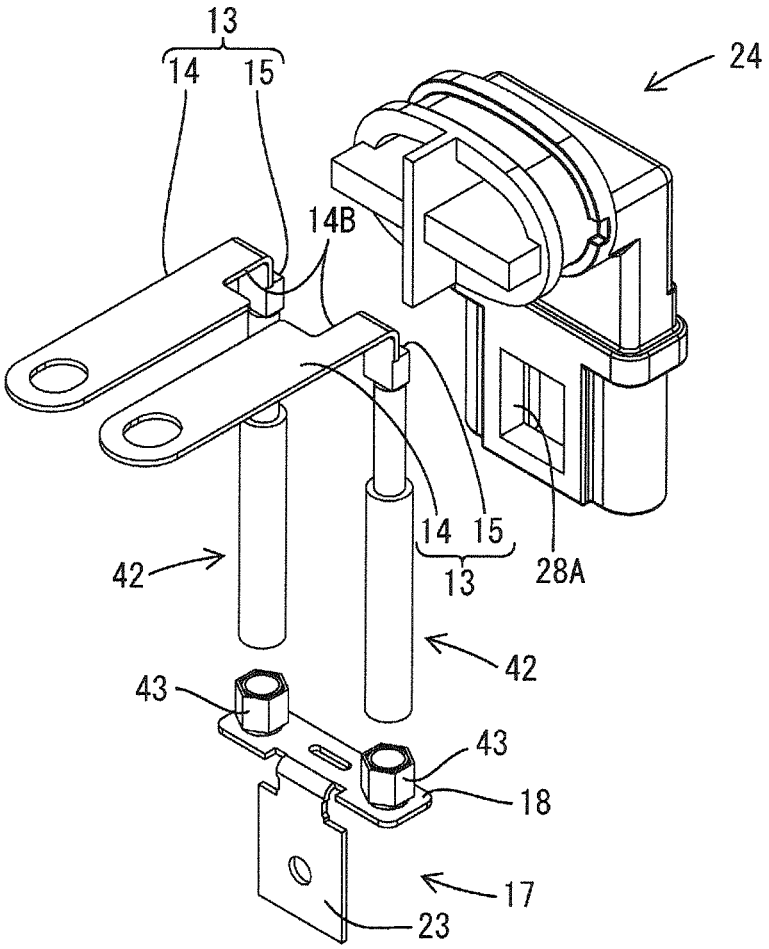
FIG. 10 is an exploded perspective view showing a molded connector main body.
Figure 11:
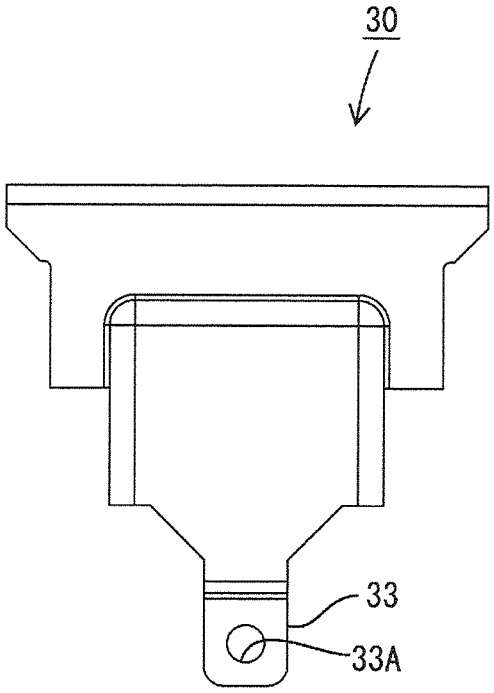
FIG. 11 is a rear view showing a first shield shell.
Figure 12:
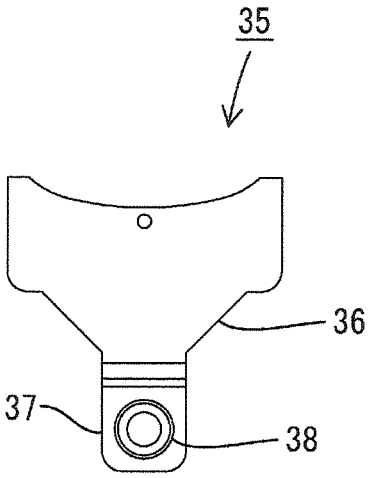
FIG. 12 is a front view showing a second shield shell.
Figure 13:
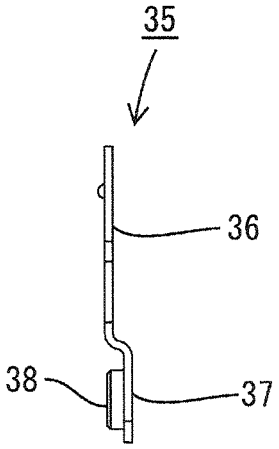
FIG. 13 is a side view showing the second shield shell.

As shown in FIG. 10, the molded connector main body 11 includes two (a plurality of) wires with terminal fittings 42, a wire shield connecting member 17 to be connected to shield layers 12C of wires 12, and a resin molded part 24 formed to include connected parts of the wires 12 and the terminal fittings 13.

Figure 6:
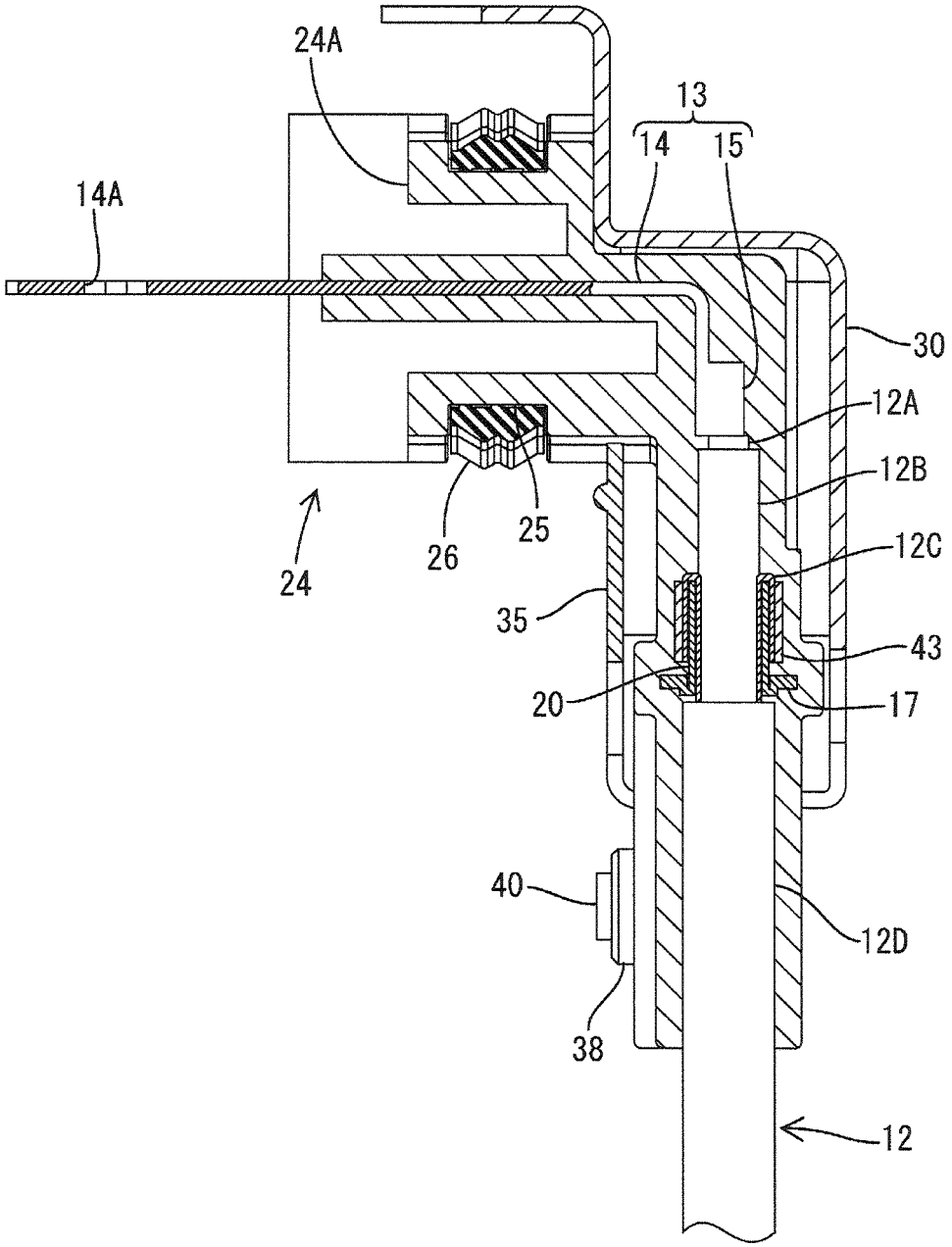
FIG. 6 is a section along B-B of FIG. 4.

As shown in FIG. 6, the wire with the terminal fitting 42 is composed of the wire 12 and an L-shaped terminal fitting 13 mounted on an end of the wire 12.

The wire 12 is configured such that a conductor 12A made of a plurality of metal thin wires is surrounded by a tubular core 12B (inner coating) made of an insulating synthetic resin material, a tubular shield layer 12C made of a braided wire formed by braiding metal thin wires is arranged along the outer periphery of the core 12B and this shield layer 12C is surrounded by a sheath 12D (outer coating) made of an insulating synthetic resin material.

The sheath 12D is removed at an upper side (end portion) of the wire 12 to expose the shield layer 12C and the core 12B is removed to expose the conductor 12A at a position further closer to the upper end.

The terminal fitting 13 is bent in an L shape, a front end side serves as a terminal connecting portion 14 in the form of a flat plate extending in a horizontal direction and a side extending downwardly serves as a wire connecting portion 15 to be connected to the conductor 12A of the wire 12.

A bolt hole 14A is formed to penetrate through the terminal connecting portion 14, and a narrower portion 14B having a smaller width is formed by cutting the inner lateral edge of a rear end part of the terminal connecting portion 14 in a step-like manner as shown in FIG. 10.

The wire connecting portion 15 is crimped to the conductor 12A of the wire 12 by swaging a pair of crimping pieces. Note that connection between the wire 12 and the terminal fitting 13 is not limited to crimping and can also be made by various other known connection methods such as welding.

The terminal fitting 13 is formed by bending a metal plate material punched out into a predetermined shape.

Figure 14:
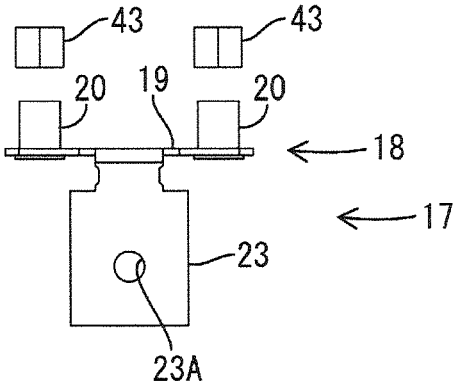
FIG. 14 is a front view showing a wire shield connecting member.
Figure 15:
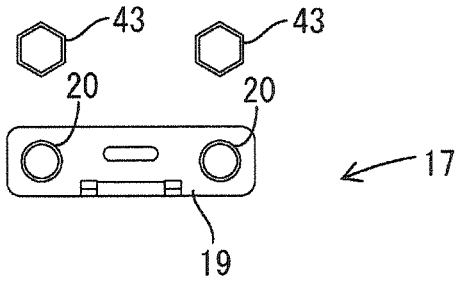
FIG. 15 is a plan view showing the wire shield connecting member.

The wire shield connecting member 17 is made of metal and composed of a layer connecting portion 18 for connecting the respective shield layers 12C of the two left and right (a plurality of) wires 12 and a third fastened piece 23 extending downwardly from a lateral edge of the layer connecting portion 18 as shown in FIG. 14.

The layer connecting portion 18 is composed of a connecting plate 19 having a rectangular shape long in a connecting direction and a pair of insertion portions 20 which are provided on the left and right sides of the connecting plate 19 and through which the wires 12 are to be inserted.

A slit extending in the lateral direction is formed to penetrate through a middle part of the connecting plate 19.

The insertion portion 20 has such a cylindrical shape that the wire 12 in a state where the sheath 12D is removed to expose the shield layer 12C is insertable therethrough.

As shown in FIG. 6, the shield layer 12C is stripped off from the core 12B, on which the shield layer 12C (braided wire) is exposed, folded back and fitted on the outer periphery of the insertion portion 20. Then, a crimp fitting 43 formed by processing an annular thin metal piece to have a hexagonal shape is swaged and crimped from outside in a state where the shield layer 12C is externally fitted on the insertion portion 20, whereby the shield layer 12C is connected to the wire shield connecting member 17.

As shown in FIG. 14, the third fastened piece 23 has a rectangular shape and a circular third through hole 23A, through which a shaft portion of a bolt 40 is to be inserted, is formed to penetrate through a central part.

As shown in FIG. 6, the resin molded part 24 is a unitary part made of a synthetic resin material and surrounding from a position behind leading end parts of the terminal fittings 13 (position before the narrower portions 14B) to parts of the wires 12 including the sheaths 12D over the entire circumference without forming any clearance, and substantially L-shaped in conformity with the shape of the terminal fittings 13.

A horizontally extending front end part of the resin molded part 24 serves as a fitting portion 24A having an elliptical shape and tubularly projecting. This fitting portion 24A is fitted into the tubular projection 53 in mounting the connector on the shield case 51. A sealing groove 25 is formed on the outer periphery of the fitting portion 24A over the entire circumference and a rubber ring 26 is mounted in this sealing groove 25.

As shown in FIG. 5, a lower end part (part from which the wires 12 extend) of the resin molded part 24 serves as a thinner portion 28 thinned by recessing the back surface side of a widthwise middle part located between the pair of wires 12.

A rectangular fastening hole 28A is formed to penetrate through the thinner portion 28.

The fastening hole 28A is somewhat smaller than the third fastened piece 23 of the wire shield connecting member 17 and arranged to be closed by the third fastened piece 23 of the wire shield connecting member 17 fixed by the resin molded part 24.

The first shield shell 30 is made of metal such as aluminum or aluminum alloy, to be mounted on the back surface side of the molded connector main body 11 (resin molded part 24) and composed of a shield portion 31 in the form of a recess in conformity with the shape of the molded connector main body 11, a protruding portion 32 protruding outwardly from the shield portion 31 and a first fastened piece 33 extending downwardly from the lower end of the shield portion 31.

As shown in FIG. 7, an upper end part of the protruding portion 32 is bent to project forward and circular mounting holes 32A are formed to penetrate through opposite end parts of this projecting part. These mounting holes 32A are aligned with the screw holes of the clamping portions 54 provided on the shield case 51 and the connector 10 is fixed to the shield case 51 by inserting screws through the mounting holes 32A and screwing them into the screw holes of the clamping portions 54.

The first fastened piece 33 has a rectangular shape of such a size that the lower end is accommodated into the fastening hole 28A, and a round first through hole 33A is formed in a central part thereof.

The second shield shell 35 is made of metal such as aluminum or aluminum alloy, to be mounted on the front surface side of the molded connector main body 11 (resin molded part 24) and composed of a shield portion 36 having an inverted triangular shape and a second fastened piece 37 extending downwardly from the lower end of the shield portion 36.

The shield portion 31 is formed substantially on the same plane.

The second fastened piece 37 is formed on a plane located behind the shield portion 31 via a step and has a rectangular shape of such a size that the lower end is accommodated into the fastening hole 28A, and a second through hole 37A on which a crimp nut 38 is to be mounted is formed in a central part thereof as shown in FIG. 5.

The second through hole 37A is circular and a front surface side is widened in a step-like manner to serve as a press-fit hole into which the crimp nut 38 is to be press-fitted.

The crimp nut 38 has an annular hexagonal outer shape, made of a material such as carbon steel, stainless steel or copper and a screw hole formed with a screw groove on the inner peripheral surface is formed to penetrate through a central part thereof. A rear end part of the crimp nut 38 is press-fitted into the press-fit hole part of the second through hole 37A, whereby the crimp nut 38 is fixed to the second shield shell 35.

Next, functions of this embodiment are described.

The terminal fittings 13 are crimped to the ends of the wires 12 to form the wires with the terminal fittings 42, the shield layers 12C folded back toward the insertion portions 20 of the wire shield connecting member 17 are fitted on the insertion portions 20, and the insertion portions 20 are swaged and crimped using the crimp fittings 43 mounted on the fitted shield layers 12C.

Subsequently, the wires with the terminal fittings 42 and the wire shield connecting member 17 are set in a molding die (not shown) to form the molded connector main body 11.

Subsequently, as shown in FIG. 7, the first shield shell 30 is mounted on the back surface side of the molded connector main body 11 and the second shield shell 35 is mounted on the front surface side of the molded connector main body 11. At this time, the first to third through holes 33A, 37A and 23A are coaxially connected. Then, the shaft portion of the bolt 40 (fastening member) is inserted through the through holes 33A, 37A and 23A and threadably engaged with the screw groove of the crimp nut 38 mounted on the second shield shell 35 to fasten the bolt 40.

This embodiment achieves the following effects.

The connector 10 includes the wires 12 with the shield layers 12C, the L-shaped terminal fittings 13 to be mounted on the ends of the wires 12, the resin molded part 24 provided to include the connected parts of the wires 12 and the terminal fittings 13, the first shield shell 30 configured to cover a predetermined part of the resin molded part 24 and including the first through hole 33A, the second shield shell 35 configured to cover the part of the resin molded part 24 not covered by the first shield shell 30, the wire shield connecting member 17 to be connected to the shield layers 12C of the wires 12 and including the third through holes 23A, and the bolt 40 (fastening member) for fastening by being inserted through the first, second and third through holes 33A, 37A and 23A.

Since the shield shells 30, 35 cover the resin molded part 24 as just described, a shielding function can be achieved by a simple configuration.

Further, three shield members, i.e. the first shield shell 30, the second shield shell 35 and the wire shield connecting member 17 are connected by being fastened by the bolt 40 (fastening member) inserted through the first to third through holes 33A, 37A and 23A. Thus, the number of fastening by the bolt 40 can be reduced as compared with the case where two each of the above members are fastened.

The first shield shell 30, the second shield shell 35 and the wire shield connecting member 17 respectively include the first fastened piece 33 (first fastened portion), the second fastened piece 37 (second fastened portion) and the third fastened piece 23 (third fastened portion) placed one next to each other on a part not including the resin molded part 24, and fastened by the bolt 40 through the respective through holes 33A, 37A and 23A provided on the respective fastened portions 33, 37 and 23.

Since the respective fastened pieces 33, 37 and 23 (fastened portions) arranged on the part not including the resin molded part 24 can be fastened by the bolt 40, a projecting distance of the bolt 40 in a thickness direction of the connector 10 can be reduced and the thickness of the connector 10 can be reduced.

Since the first shield shell 30 covers the back surface side, the second shield shell 35 covers the front surface side, and the wire shield connecting member 17 is fastened by the bolt 40 while being sandwiched between the first and second shield shells 30, 35, the respective shield shells 30, 35 are separated at front and rear sides and easily mounted, wherefore the connector 10 can be easily assembled.

There are a plurality of wires 12, the wire shield connecting member 17 includes the insertion portions 20 into which the plurality of wires 12 are to be inserted and which are to be connected to the shield layers 12C and the third fastened piece 23 (third fastened portion) in the form of a plate extending from the insertion portions 20 in a direction perpendicular to an arrangement direction of the plurality of wires 12, and the third fastened piece 23 is formed with the third through hole 23A. Thus, a configuration for connecting the shield layers 12C of the wires 12 to the shield shells 30, 35 can be simplified.

Next, a second embodiment of the present invention is described with reference to FIGS. 16 to 32.

Figure 16:
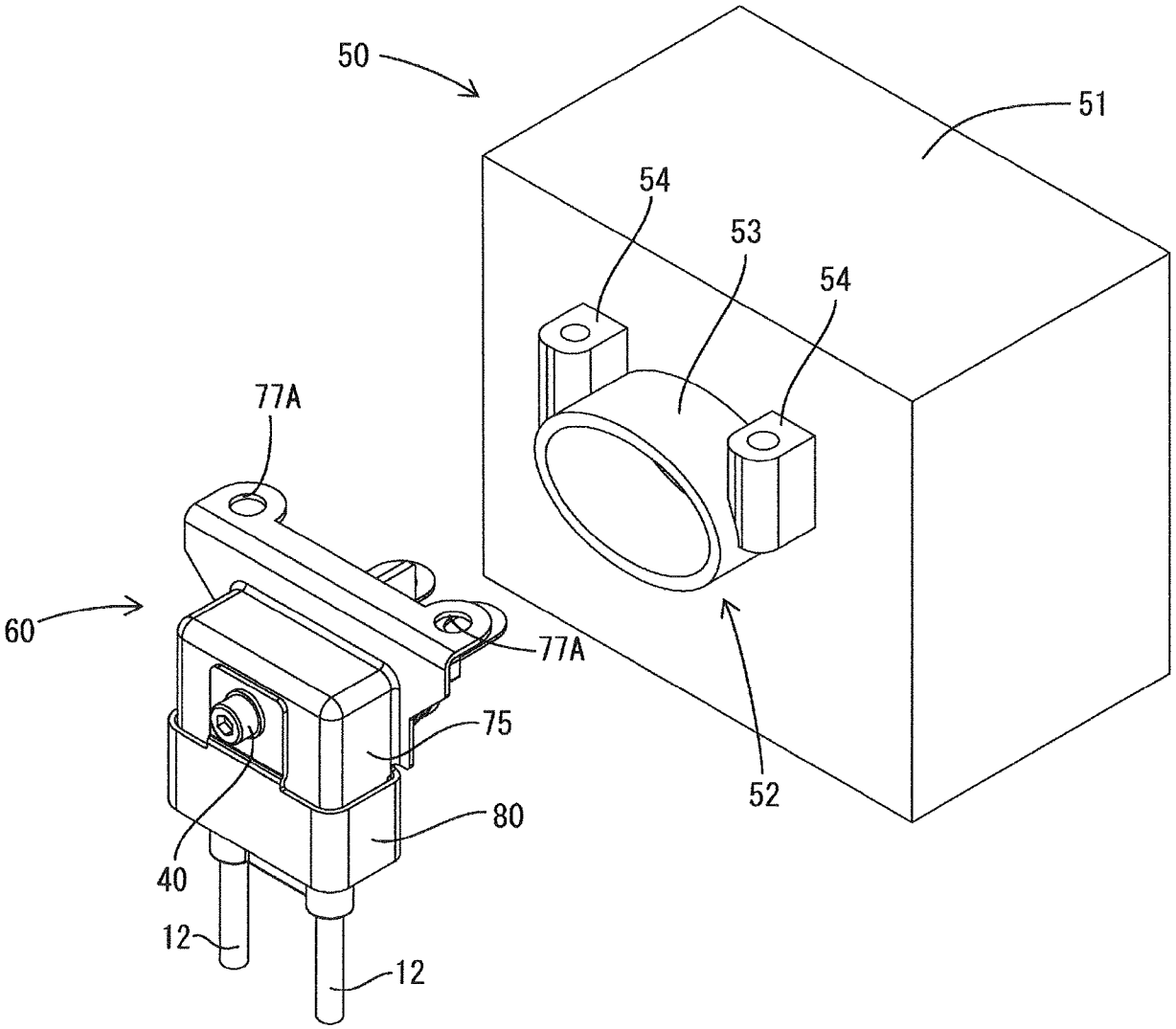
FIG. 16 is a view showing a state where a connector of a second embodiment is being mounted on a device.
Figure 17:
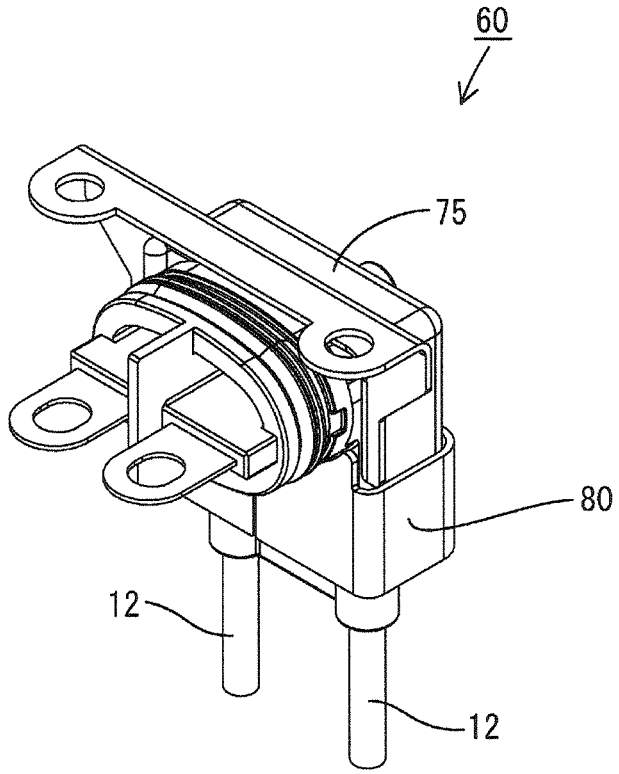
FIG. 17 is a perspective view showing the connector.
Figure 18:
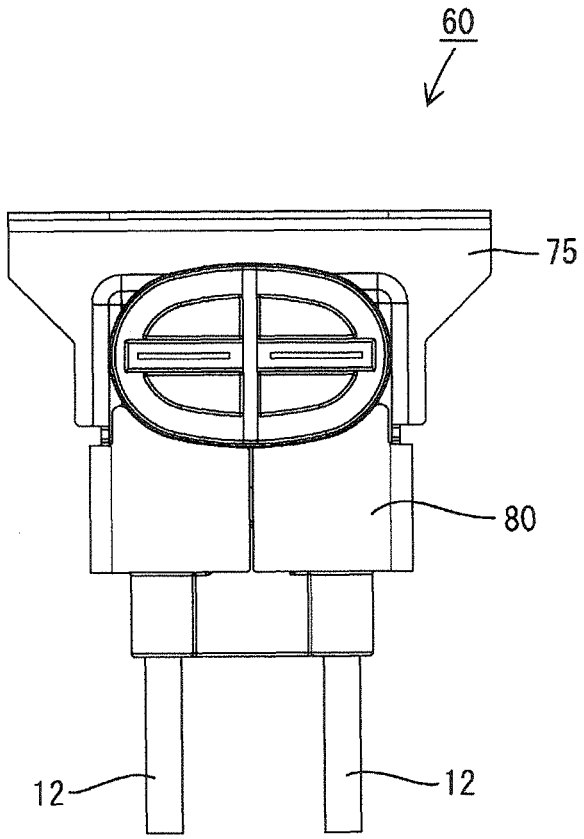
FIG. 18 is a front view showing the connector.
Figure 19:
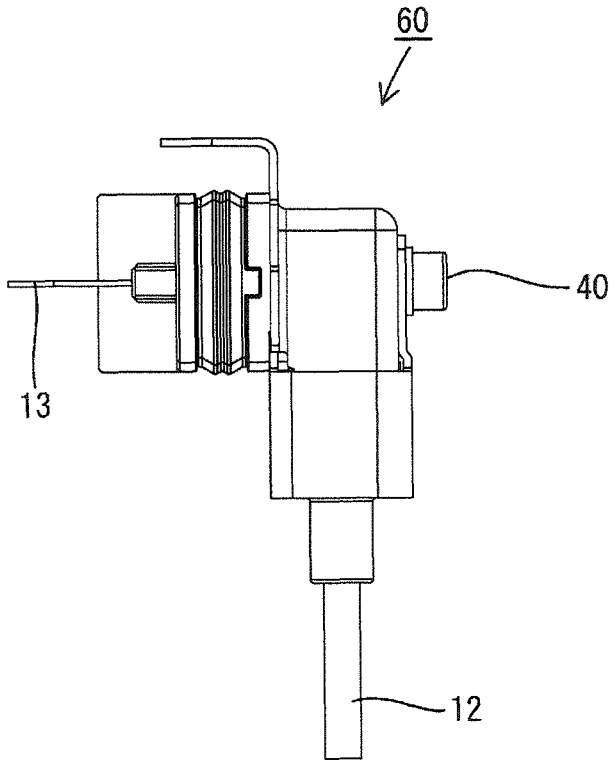
FIG. 19 is a side view showing the connector.
Figure 20:
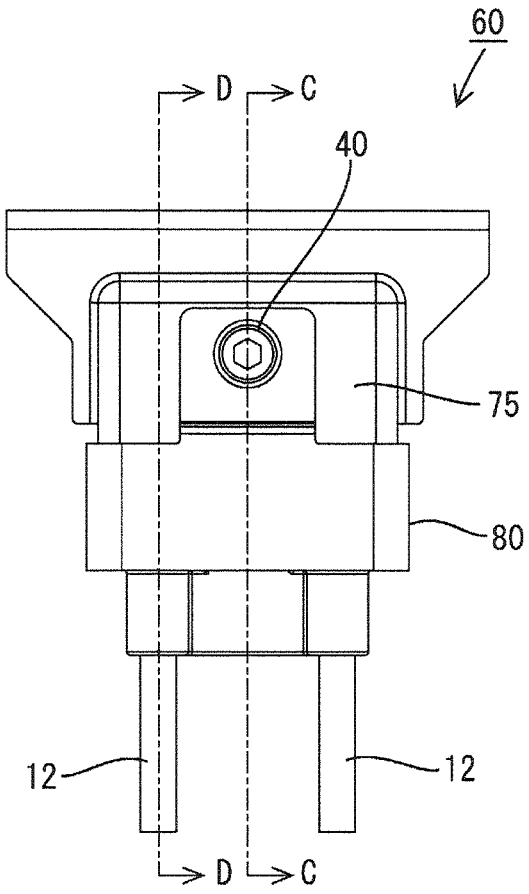
FIG. 20 is a rear view showing the connector.
Figure 21:
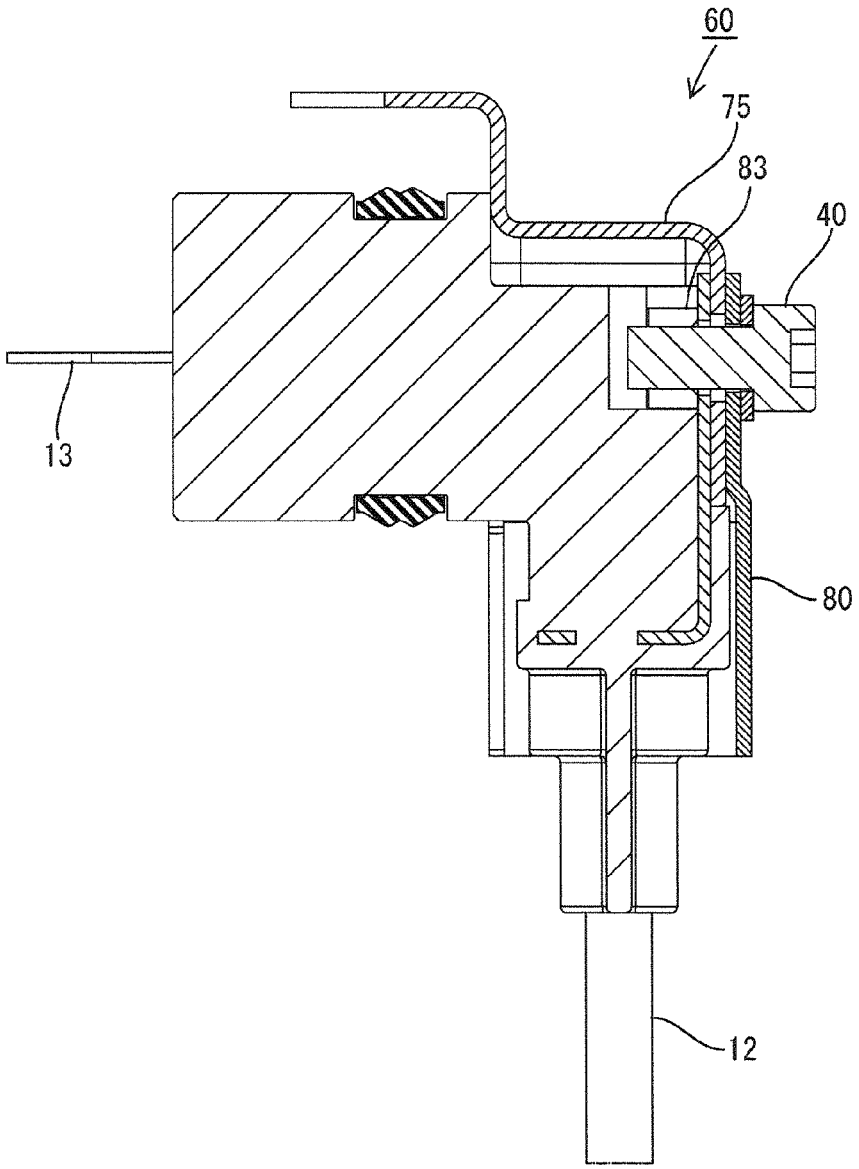
FIG. 21 is a section along C-C of FIG. 20.
Figure 22:
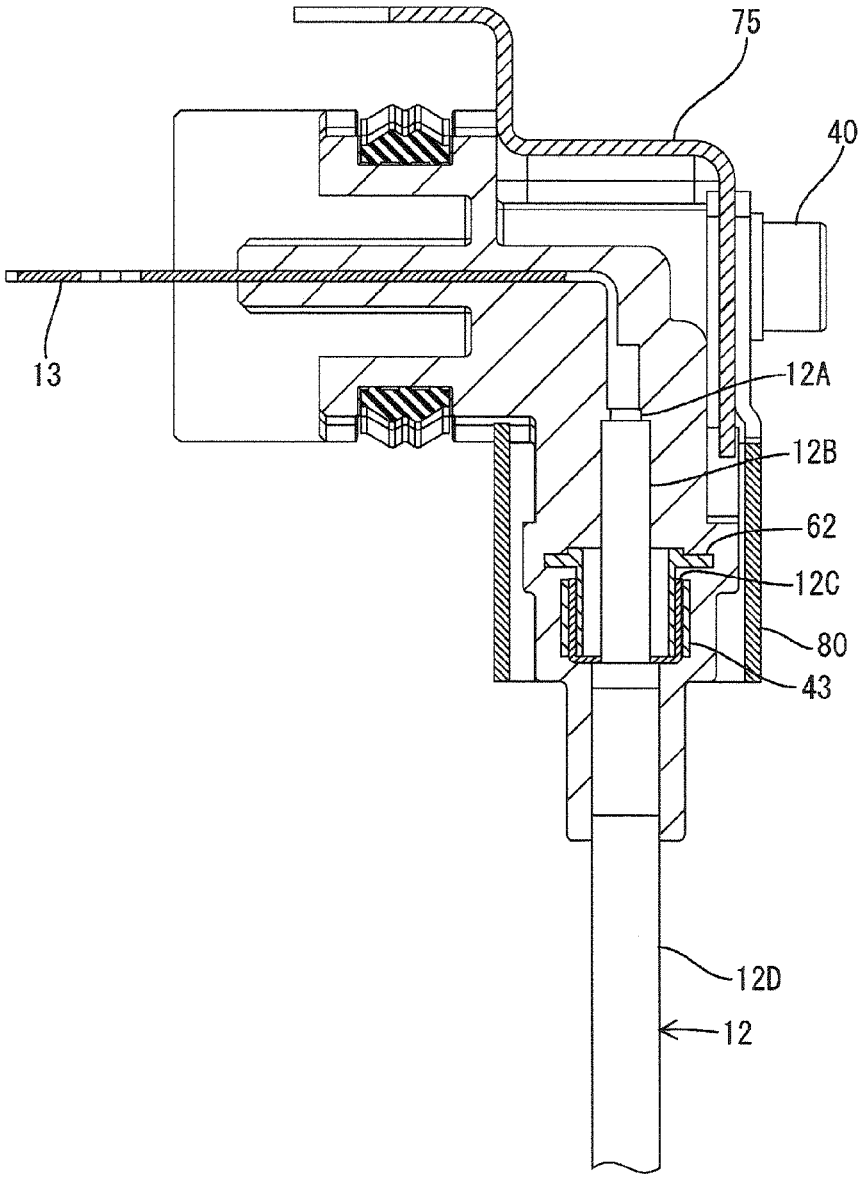
FIG. 22 is a section along D-D of FIG. 20.

Although the bolt 40 as the fastening member is provided for fastening at a lower part of the connector 10 not including the resin molded part 24 in the first embodiment, a bolt 40 is provided for fastening at an upper part of a back surface side of a connector 60 as shown in FIG. 16. In the following description, a vertical direction is based on FIG. 21 and left and right sides in FIG. 21 are respectively referred to as front and rear sides. Further, the same components as in the first embodiment are denoted by the same reference signs and not described.

As shown in FIG. 16, the connector 60 of this embodiment is to be mounted on a shield case 51 of a device 50 (e.g. inverter device or the like of a hybrid vehicle or an electric vehicle).

Figure 23:
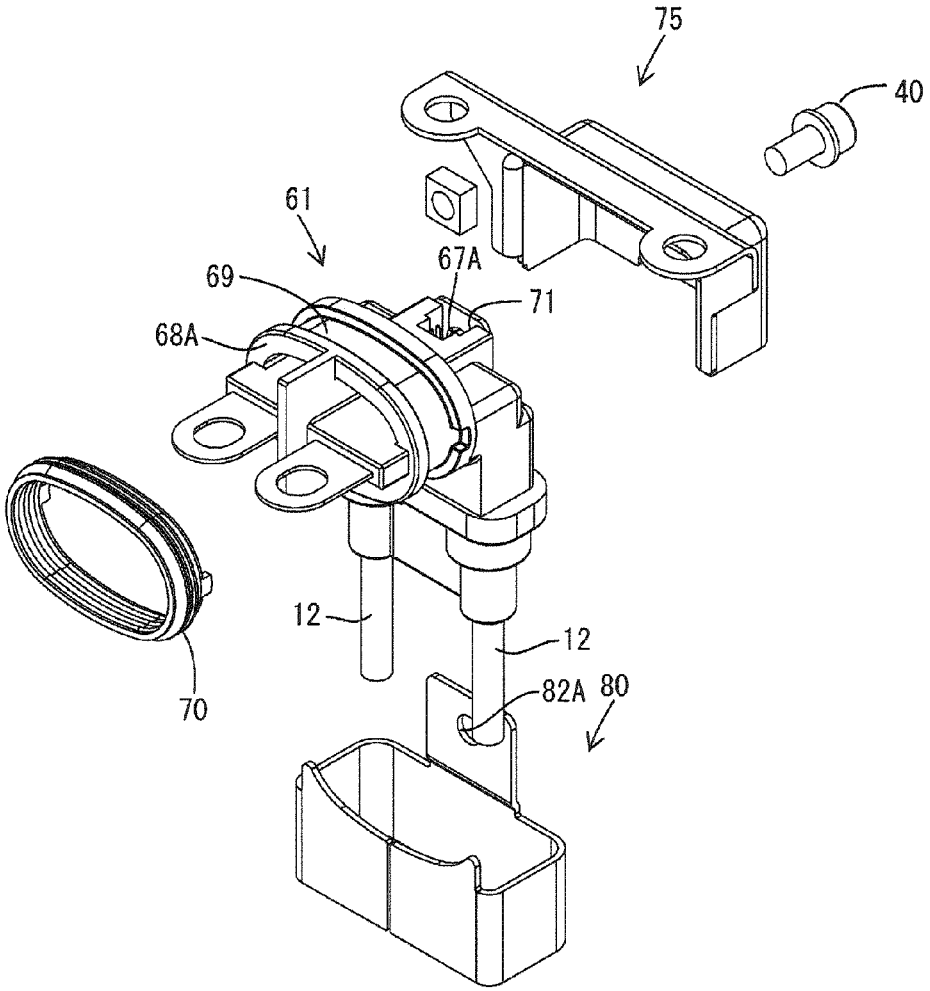
FIG. 23 is an exploded perspective view showing the connector.

As shown in FIG. 23, the connector 60 includes a molded connector main body 61, a first shield shell 75 for covering a back surface side of the molded connector main body 61 and a second shield shell 80 for covering a front surface side of the molded connector main body 61.

Figure 26:
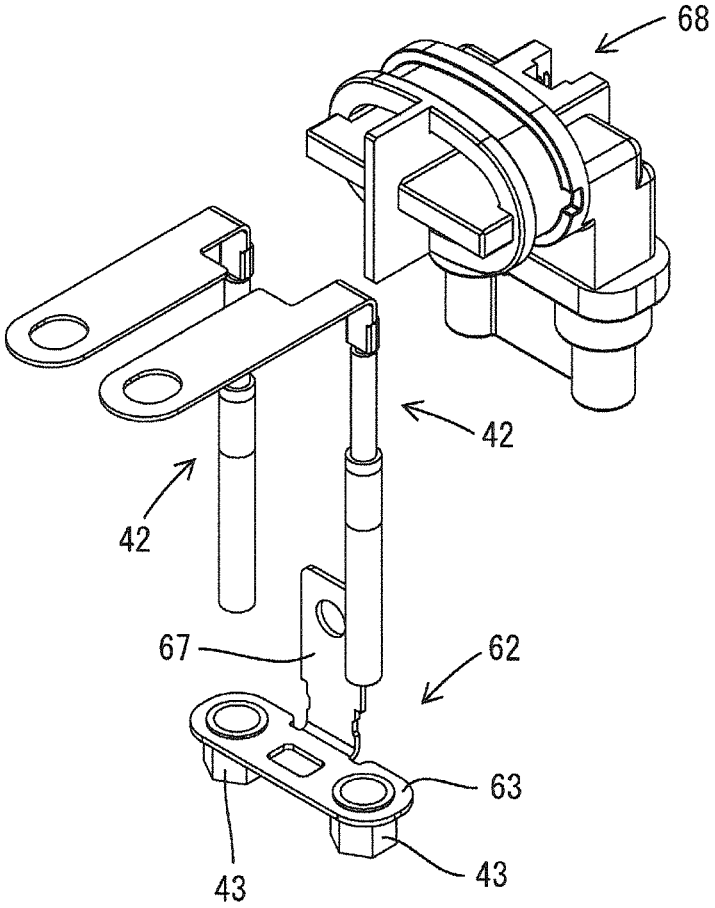
FIG. 26 is an exploded perspective view showing a molded connector main body.

As shown in FIG. 26, the molded connector main body 61 includes wires with terminal fittings 42, a wire shield connecting member 62 to be connected to shield layers 12C of wires 12, and a resin molded part 68 formed to include connected parts of the wires 12 and terminal fittings 13.

The wire shield connecting member 62 is composed of a layer connecting portion 63 for connecting the respective shield layers 12C of the two left and right (a plurality of) wires 12, and a third fastened piece 67 extending upwardly from a lateral edge of the layer connecting portion 63.

Figure 31:
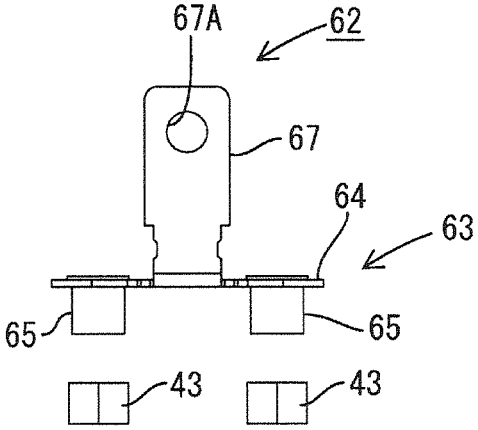
FIG. 31 is a front view showing a wire shield connecting member.
Figure 32:
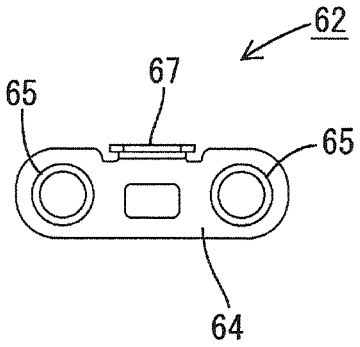
FIG. 32 is a plan view showing the wire shield connecting member.

As shown in FIG. 31, the layer connecting portion 63 is composed of a connecting plate 64 having a rectangular shape long in a connecting direction and a pair of insertion portions 65 which are provided on the left and right sides of the connecting plate 64 and through which the wires 12 are to be inserted.

A slit extending in a lateral direction is formed to penetrate through a middle part of the connecting plate 64.

The insertion portion 65 has such a cylindrical shape that the wire 12 in a state where a sheath 12D is removed to expose the shield layer 12C is inserted therethrough.

The shield layer 12C is stripped off from a core 12B, on which the shield layer 12C (braided wire) is exposed, folded back toward the insertion portion 65 and fitted to cover the outer periphery of the insertion portion 65. Then, a crimp fitting 43 formed by processing an annular thin metal piece to have a hexagonal shape is swaged and crimped from outside in a state where the shield layer 12C is externally fitted on the insertion portion 65, whereby the shield layer 12C and the wire shield connecting member 62 are connected.

The third fastened piece 67 has a rectangular shape long in the vertical direction and a circular third through hole 67A, through which a shaft portion of the bolt 40 is to be inserted, is formed to penetrate through a central part.

Figure 25:
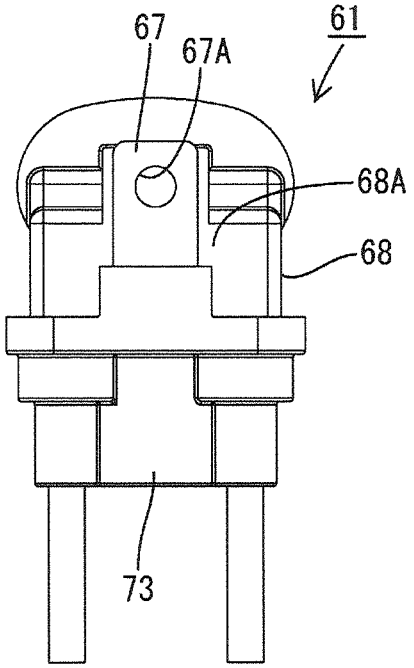
FIG. 25 is a rear view showing the molded connector.

This third fastened piece 67 is held in close contact with a flat portion 68B on the back surface of the resin molded part 68 (molded connector main body 61) as shown in FIG. 25 in a state fixed to the resin molded part 68.

As shown in FIG. 23, the resin molded part 68 is a unitary part made of a synthetic resin material and surrounding from a position behind leading end parts of the terminal fittings 13 (position before narrower portions 14B) to parts of the wires 12 including the sheaths 12D (insulation coating) over the entire circumference without forming any clearance, and substantially L-shaped in conformity with the shape of the terminal fittings 13.

A horizontally extending front end part of the resin molded part 68 serves as a fitting portion 68A having an elliptical shape and tubularly projecting. This fitting portion 68A is fitted into a tubular projection 53 in mounting the connector on the shield case 51. A sealing groove 69 is formed on the outer periphery of the fitting portion 68A over the entire circumference and a rubber ring 70 is mounted in this sealing groove 69.

Figure 24:
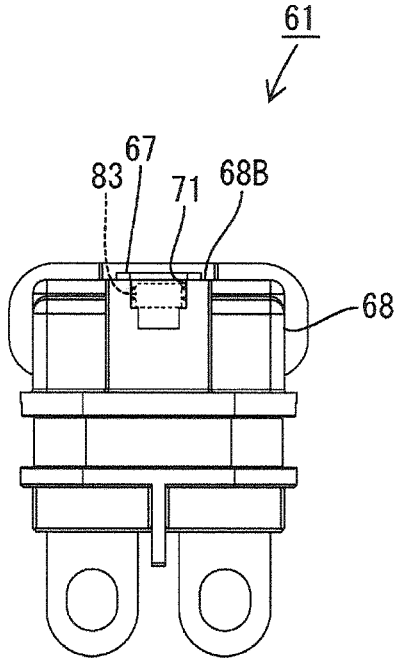
FIG. 24 is a front view showing the molded connector.

As shown in FIG. 24, the flat portion 68B on which the third fastened piece 67 is arranged is provided on a back surface side of the resin molded part 68 and a fastening recess 71 is formed on an upper end part (position corresponding to the third through hole 67A on an upper end part of the flat portion 68A) of the back surface of the resin molded part 68.

The fastening recess 71 is composed of a nut holding portion in which a nut 83 is to be held and a shaft portion insertion portion which is so formed before the nut holding portion to have a smaller diameter while forming a step and into which the shaft portion of the bolt 40 is to be inserted.

As shown in FIG. 25, a lower end part (part from which the wires 12 extend) of the resin molded part 68 is thinned in a widthwise middle part by recessing the back surface side, thereby forming a thinner portion 73.

Figure 27:
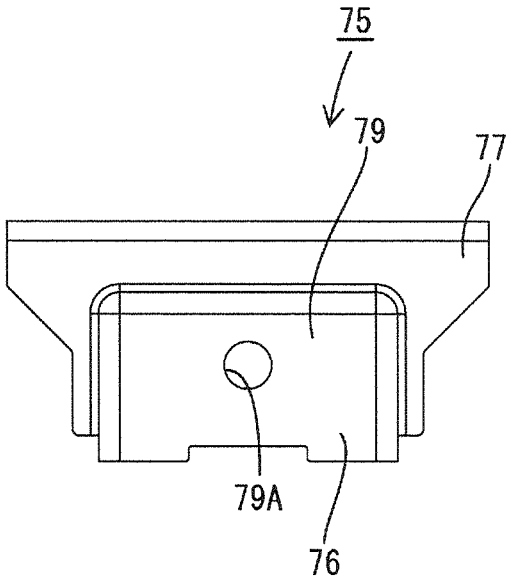
FIG. 27 is a rear view showing a first shield shell.

The first shield shell 75 is made of metal such as aluminum or aluminum alloy, to be mounted on the back surface side of the molded connector main body 61 (resin molded part 68) and composed of a shield portion 76 in the form of a recess in conformity with the shape of the molded connector main body 61 and a protruding portion 77 protruding outwardly from the shield portion 76 as shown in FIG. 27.

A central part of the flat rear end surface of the shield portion 76 serves as a first fastened portion 79 and a first through hole 79A is formed in a central part of the first fastened portion 79.

Figure 28:
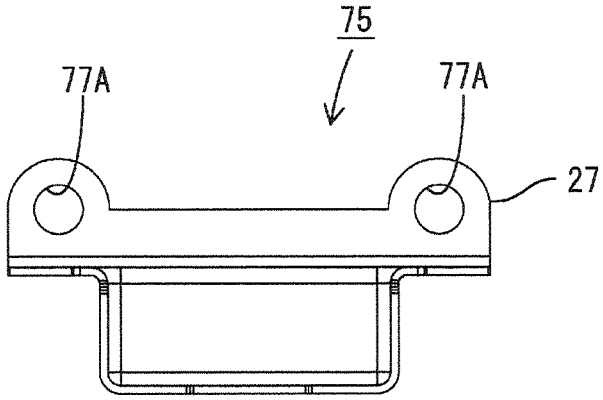
FIG. 28 is a bottom view showing the first shield shell.

As shown in FIG. 28, an upper end part of the protruding portion 77 is bent to project forward and circular mounting holes 77A are formed to penetrate through opposite end parts of this projecting part. The connector 60 is fixed to the shield case 51 by inserting screws through the mounting holes 77A and screwing them into the screw holes of the clamping portions 54.

Figure 29:
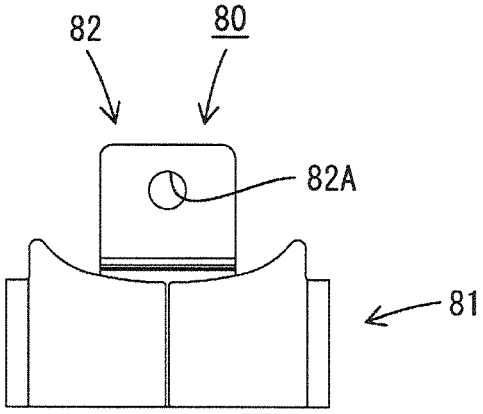
FIG. 29 is a front view showing a second shield shell.
Figure 30:
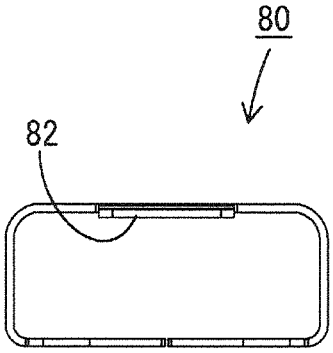
FIG. 30 is a plan view showing the second shield shell.

The second shield shell 80 is made of metal such as aluminum or aluminum alloy and composed of a tubular tube main body 81 and a second fastened piece 82 extending upwardly from the tube main body 81 as shown in FIG. 29.

The tube main body 81 is in the form of a rectangular tube composed of a pair of shorter surfaces and a pair of longer surfaces facing each other, and the second fastened piece 82 extends upwardly from one longer surface side in flush with the tube main body 81.

A circular second through hole 82A is formed to penetrate through a central part of the second fastened piece 82.

The second shield shell 80 is formed by bending a metal plate material punched out into a development shape such that opposite ends are butted against each other.

Next, functions of this embodiment are described.

The terminal fittings 13 are crimped to the ends of the two wires 12 to form the wires with the terminal fittings 42, the folded-back shield layers 12C are fitted to cover the respective insertion portions 65 of the wire shield connecting member 62, and the crimp fittings 43 are swaged and crimped on the shield layers 12C. At this time, the two wires 12 are inserted through the second shield shell 80 in advance.

The wires with the terminal fittings 42 and the wire shield connecting member 62 are set in a molding die (not shown) to form the molded connector main body 61.

Subsequently, when the second shield shell 80 is mounted from below the molded connector main body 61 and the first shield shell 75 is mounted on the back surface side of the molded connector main body 61 as shown in FIG. 23, the respective through holes 79A, 82A and 67A are connected. Then, the nut 83 is accommodated into the fastening recess 71 of the resin molded part 68 and the shaft portion of the bolt 40 (fastening member) is inserted through all the through holes 79A, 72A and 67A and screwed into the nut 83 to fasten the bolt 40, whereby the connector 60 is assembled.

The second embodiment achieves the following effects.

The connector 60 includes the wires 12 with the shield layers 12C, the L-shaped terminal fittings 13 to be mounted on the ends of the wires 12, the resin molded part 68 provided to include the connected parts of the wires 12 and the terminal fittings 13, the first shield shell 75 configured to cover a predetermined part of the resin molded part 68 and including the first through hole 79A, the second shield shell 80 configured to cover the part of the resin molded part 68 not covered by the first shield shell 75 and including the second through hole 82A, the wire shield connecting member 62 connected to the shield layers 12C of the wires 12 and including the third through hole 67A, and the bolt 40 (fastening member) for fastening by being inserted through the first, second and third through holes 79A, 82A and 67A.

Since the shield shells 75, 80 cover the resin molded part 68 as just described, a shielding function can be achieved by a simple configuration.

Further, three shield members, i.e. the first shield shell 75, the second shield shell 80 and the wire shield connecting member 62 are connected by being fastened by the bolt 40 inserted through the respective through holes 79A, 82A and 67A of the three members. Thus, the number of fastening by the bolt 40 can be reduced (one is sufficient) as compared with the case where two each of the above members are fastened.

The second shield shell 80 has a tubular shape surrounding a part of the resin molded part 68 from which the wire extends, and the first shield shell 75 covers the back surface side of the resin molded part 68 not covered by the first shield shell 75.

As compared with the case where the first and second shield shells 75, 80 are separated at front and rear sides, positioning in assembling the first and second shield shells 75, 80 can be facilitated.

There are a plurality of wires 12, the wire shield connecting member 62 includes the insertion portions 65 into which the plurality of wires 12 are to be inserted and which are to be connected to the shield layers 12C and the third fastened piece 67 (third fastened portion) in the form of a plate extending from the insertion portions 65 in a direction perpendicular to an arrangement direction of the plurality of wires 12, and the third fastened piece 67 (third fastened portion) is formed with the third through hole 67A. Thus, a configuration for connecting the shield layers 12C of the wires 12 to the shield shells 75, 80 can be simplified.

Next, a reference example of the present invention is described with reference to FIGS. 33 to 42. In the following description, the same components as in the above embodiments are denoted by the same reference signs and not described.

Figure 33:
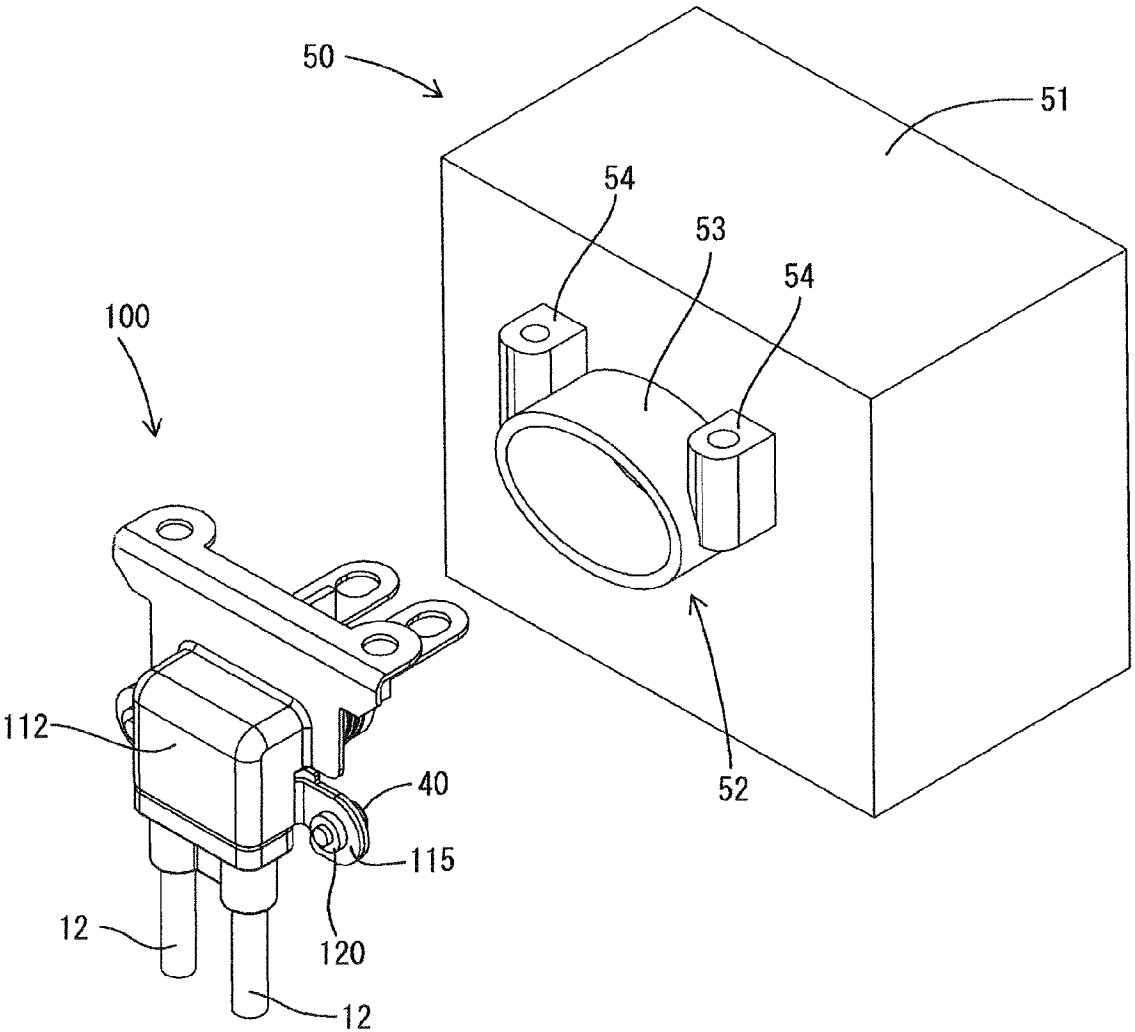
FIG. 33 is a view showing a state where a connector as a reference example is being mounted on a device.
Figure 34:
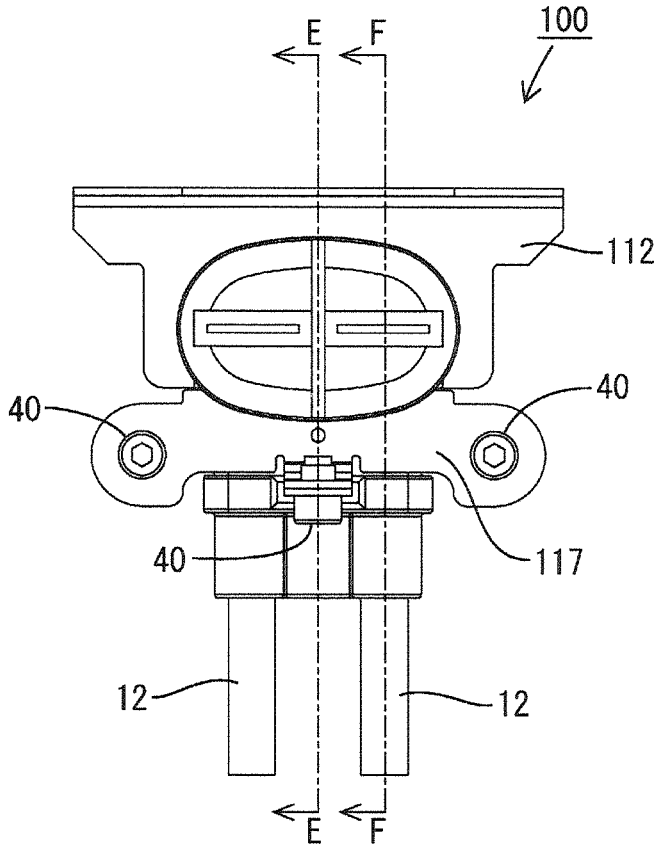
FIG. 34 is a front view showing the connector.
Figure 35:
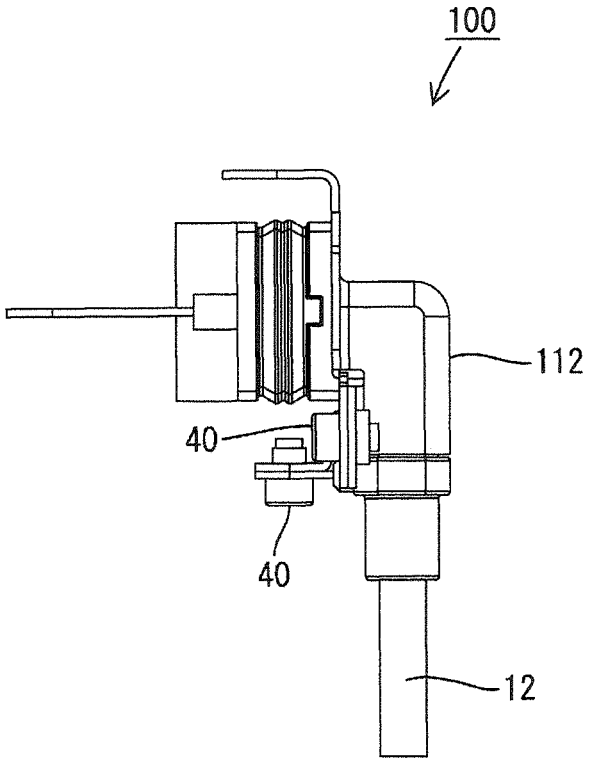
FIG. 35 is a side view showing the connector.
Figure 36:
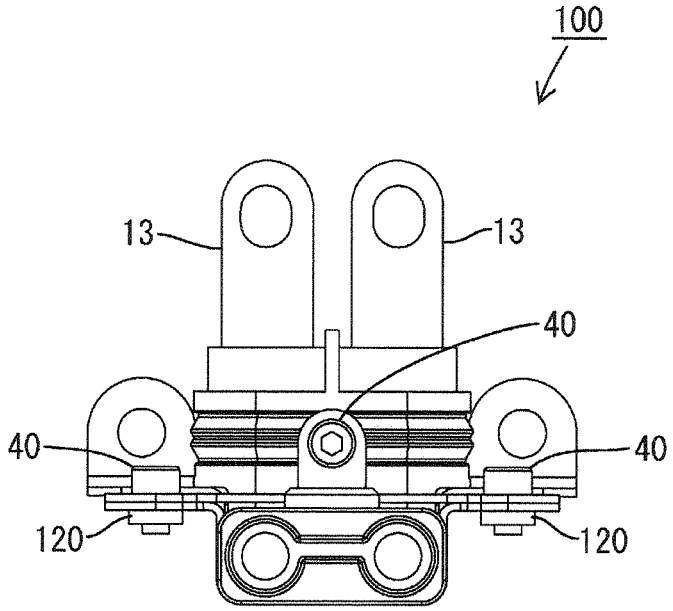
FIG. 36 is a bottom view showing the connector.
Figure 37:
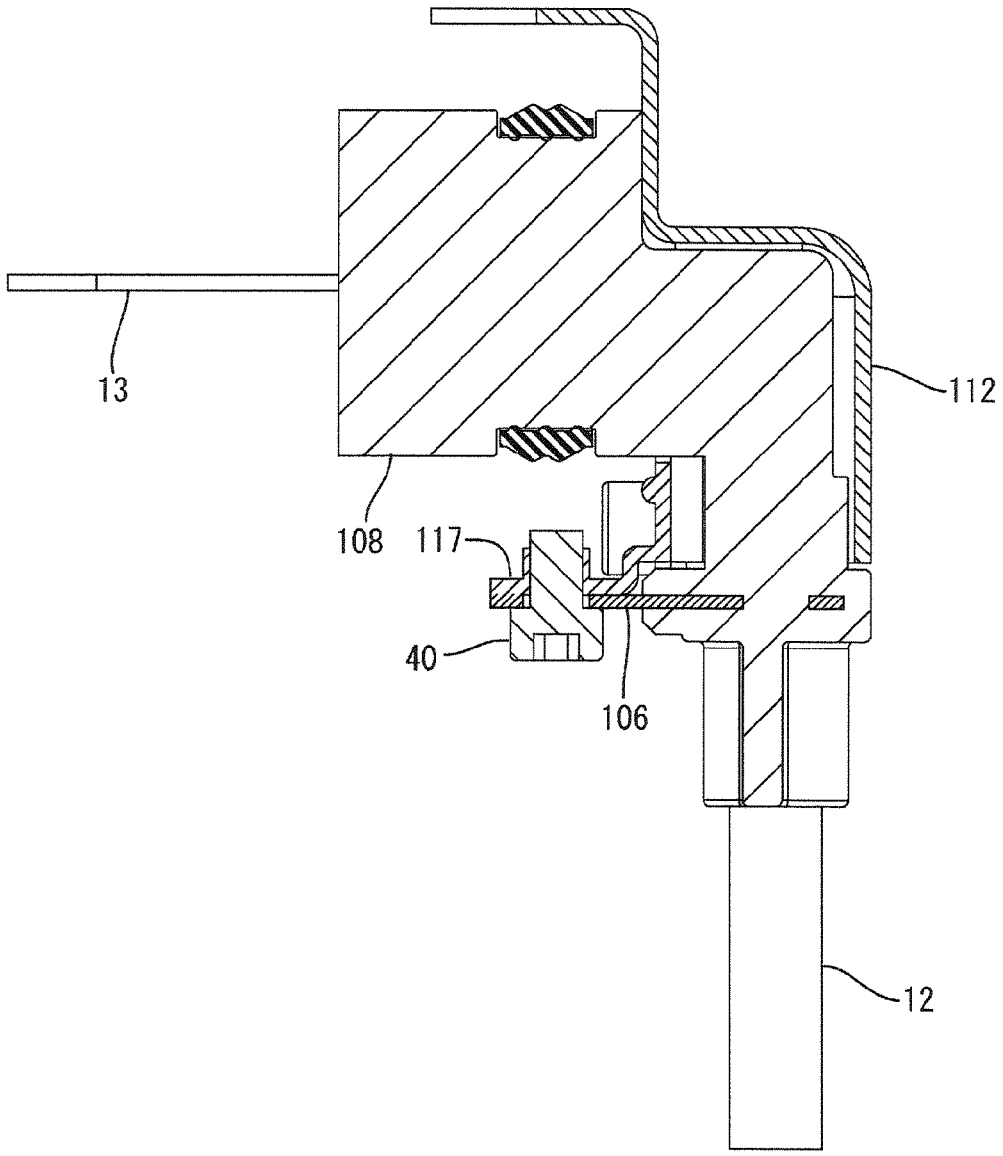
FIG. 37 is a section along E-E of FIG. 34.

As shown in FIG. 33, a connector 100 of this reference example is to be mounted on a shield case 51 of a device 50 (e.g. inverter device or the like of a hybrid vehicle or an electric vehicle). In the following description, a vertical direction is based on FIG. 37 and left and right sides in FIG. 37 are respectively referred to as front and rear sides.

Figure 39:
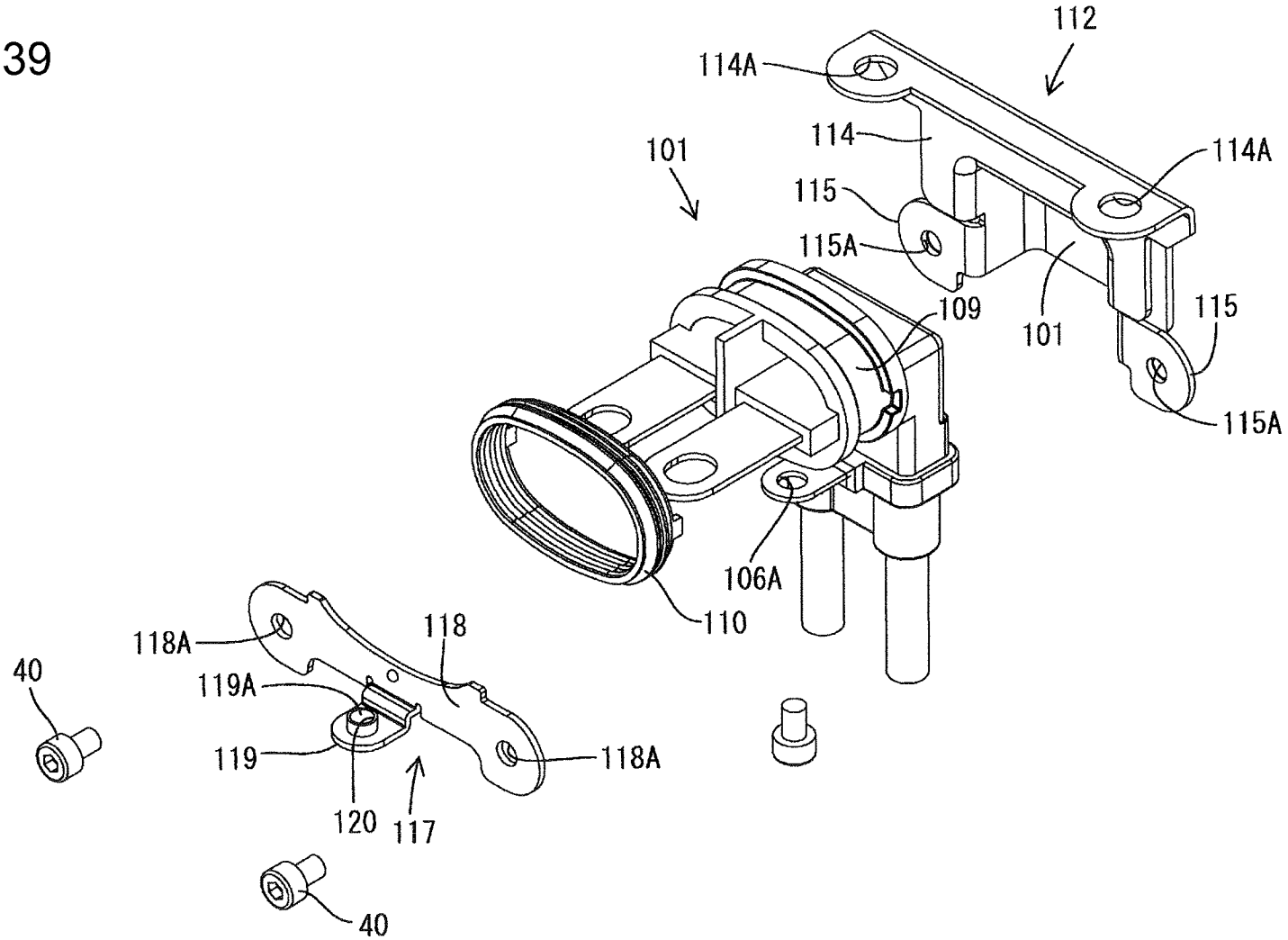
FIG. 39 is an exploded perspective view of the connector.

As shown in FIG. 39, the connector 100 includes a molded connector main body 101, a first shield shell 112 for covering a back surface side of the molded connector main body 101 and a second shield shell 117 for covering a front surface side of the molded connector main body 101.

Figure 40:
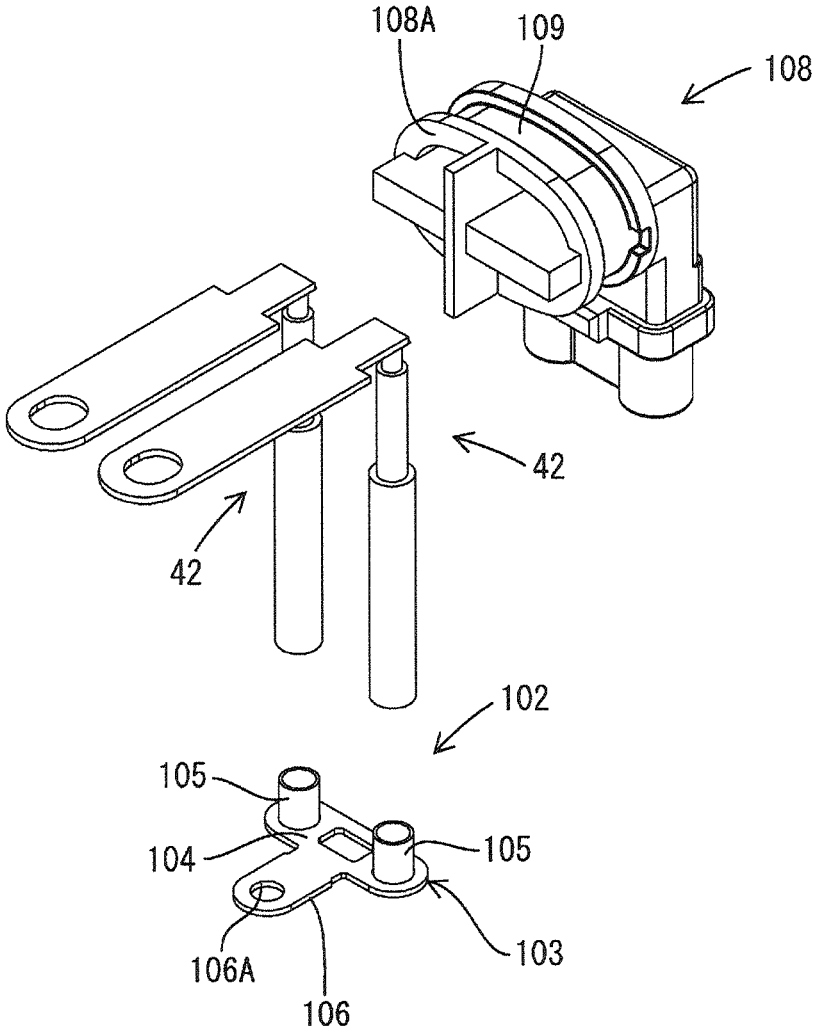
FIG. 40 is an exploded perspective view of a molded connector main body.

As shown in FIG. 40, the molded connector main body 101 includes wires with terminal fittings 42, a wire shield connecting member 102 to be connected to shield layers 12C of wires 12, and a resin molded part 108 formed to include connected parts of the wires 12 and terminal fittings 13.

The wire shield connecting member 102 is composed of a layer connecting portion 103 for connecting the respective shield layers 12C of the two left and right (a plurality of) wires 12, and a fastened piece 106 extending forwardly from a lateral edge of the layer connecting portion 103.

The layer connecting portion 103 is composed of a connecting plate 104 long in a connecting direction and a pair of insertion portions 105 which are provided on the left and right sides of the connecting plate 104 and through which the wires 12 are to be inserted.

A rectangular hole is formed to penetrate through a middle part of the connecting plate 104.

The insertion portion 105 has such a cylindrical shape that the wire 12 in a state where a sheath 12D is removed to expose the shield layer 12C is inserted therethrough. This insertion portion 105 is formed separately from the connecting plate 104 and an end edge of the sleeve-like insertion portion 105 is engaged with the hole edge of an insertion hole provided in the connecting plate 104.

The shield layer 12C is stripped off from a core 12B, on which the shield layer 12C (braided wire) is exposed, folded back toward the insertion portion 105 and fitted to cover the outer periphery of the insertion portion 105. Then, a crimp fitting 43 formed by processing an annular thin metal piece to have a hexagonal shape is swaged and crimped from outside in a state where the shield layer 12C is externally fitted on the insertion portion 105, whereby the shield layer 12C and the wire shield connecting member 102 are connected.

The fastened piece 106 is shaped to be long in forward and backward directions and formed to be flush with the connecting plate 104, and a circular through hole 106A, through which a shaft portion of a bolt 40 is to be inserted, is formed to penetrate through a central part.

The resin molded part 108 is a unitary part made of a synthetic resin material and surrounding from a position behind leading end parts of the terminal fittings 13 (position before narrower portions 14B) to parts of the wires 12 including the sheaths 12D over the entire circumference without forming any clearance, and substantially L-shaped in conformity with the shape of the terminal fittings 13.

A horizontally extending front end part of the resin molded part 108 serves as a fitting portion 108A having an elliptical shape and tubularly projecting. This fitting portion 108A is fitted into a tubular projection 53 in mounting the connector on the shield case 51. A sealing groove 109 is formed on the outer periphery of the fitting portion 108A over the entire circumference and a rubber ring 110 is mounted in this sealing groove 109.

Figure 41:
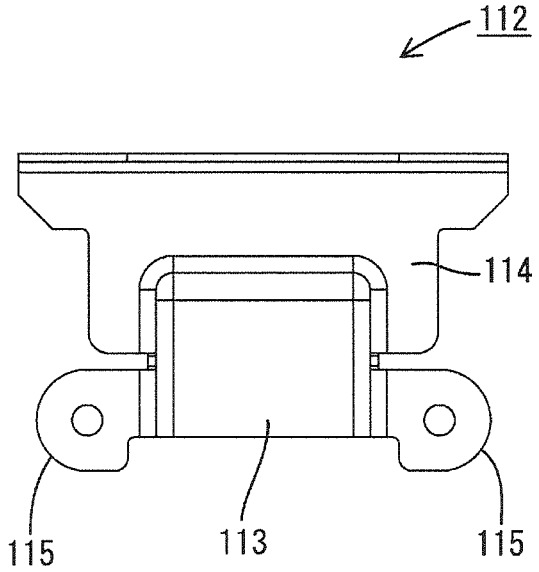
FIG. 41 is a rear view showing a first shield shell.
Figure 42:
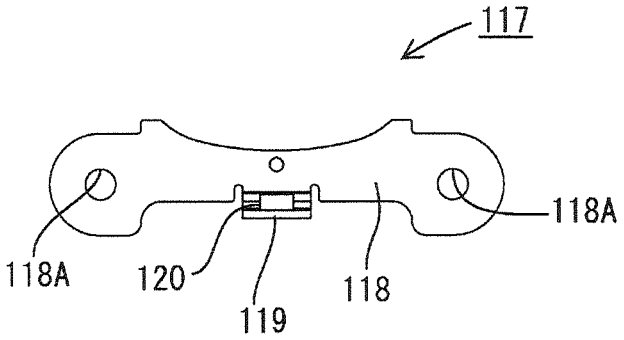
FIG. 42 is a front view showing a second shield shell.

The first shield shell 112 is made of metal such as aluminum or aluminum alloy, to be mounted on the back surface side of the molded connector main body 101 (resin molded part 108) and composed of a shield portion 113 in the form of a recess in conformity with the shape of the molded connector main body 101, a protruding portion 114 protruding outwardly from an upper side of the shield portion 113 and fastened pieces 115 protruding outwardly from a lower side of the shield portion 113 as shown in FIG. 41.

As shown in FIG. 39, an upper end part of the protruding portion 114 is bent to project forward and circular mounting holes 114A are formed to penetrate through opposite end parts of this projecting part.

A circular through hole 115A is formed to penetrate through each of a pair of fastened pieces 115.

The second shield shell 117 is made of metal such as aluminum or aluminum alloy, to be mounted on the front surface side of the molded connector main body 101 (resin molded part 108) and composed of a connecting portion 118 in the form of a flat plate long in the lateral direction and a fastened piece 119 extending forwardly (direction perpendicular to a connecting direction of the connecting portion) from one lateral edge of a middle part of the connecting portion 118.

Through holes 118A are respectively formed to penetrate through left and right end parts of the connecting portion 118 widened in a step-like manner.

The fastened piece 119 is formed to have a round front end side and a circular through hole 119A is formed to penetrate through a central part thereof.

The peripheral edge of the through hole 119A is thickened by slightly projecting upward to have a tubular shape, thereby serving as a screw portion 120. A screw groove to be threadably engaged with the shaft portion of the bolt 40 is formed on the through hole 119A that is the inner peripheral surface of the screw portion 120.

Next, functions of this embodiment are described.

Figure 38:
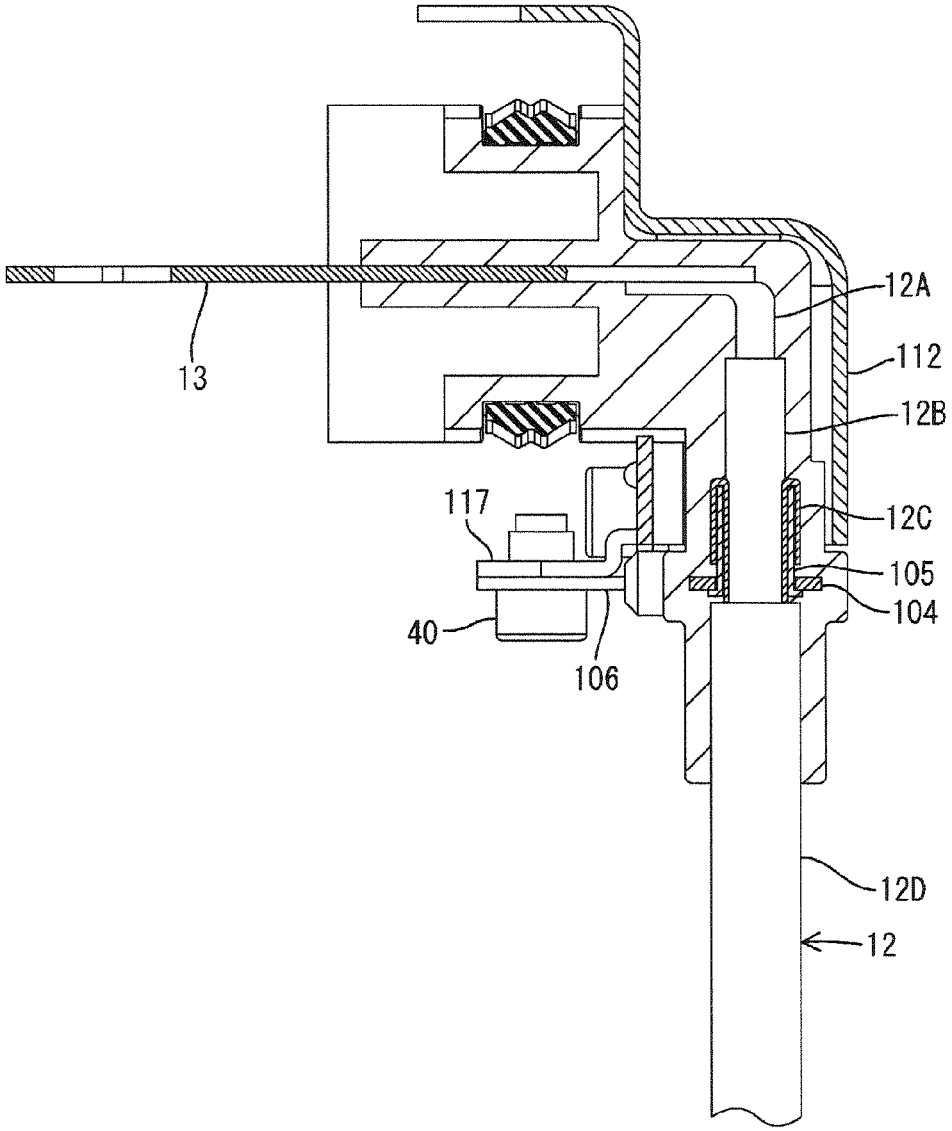
FIG. 38 is a section along F-F of FIG. 34.

The terminal fittings 13 are crimped to the ends of the two wires 12 to form the wires with the terminal fittings 42, and the folded-back shield layers 12C are fitted to cover the respective insertion portions 105 of the wire shield connecting member 102 and electrically connected by a known connecting direction such as welding or soldering (see FIG. 38).

Subsequently, the wires with the terminal fittings 42 and the wire shield connecting member 102 are set in a molding die (not shown) to form the molded connector main body 101.

Subsequently, as shown in FIG. 39, the second shield shell 117 is so mounted on the front surface side of the molded connector main body 101 that the through hole 119A of the screw portion 120 is located above the through hole 106A and the bolt 40 is screwed into the screw portion 120. Further, the first shield shell 112 is mounted on the back surface side of the molded connector main body 101 and the through holes 115 of the fastened pieces 115 of the first shield shell 112 and the through holes 118A of the fastened piece 118 of the second shield shell 117 are fastened by bolts 40 and nuts 120.

As just described, since the shield shells 112, 117 cover the resin molded part 108 according to this reference example, a shielding function can be achieved by a simple configuration.

Here, in this reference example, two each of the first shield shell 112, the second shield shell 117 and the wire shield connecting member 102 are fastened by inserting the bolts 40 (fastening member) through the respective through holes 106A, 115A, 119A and 118A. On the other hand, if the first shield shell 112, the second shield shell 117 and the wire shield connecting member 102 are connected by being fastened by the bolt 40 (fastening member) inserted through the respective through holes 106A, 115A, 110A and 118A of the three members as in the first and second embodiments described above, the number of fastening by the bolt 40 (fastening member) can be reduced as compared with the case where two each of the members are fastened as in this reference example.

Hereinafter, a connector 130 according to a specific third embodiment of the present invention is described with reference to FIGS. 43 to 47. In the following description, a vertical direction is based on FIG. 45, left and right sides in FIG. 45 are respectively referred to as front and rear sides, and the same components as in the above embodiments are denoted by the same reference signs and not described as appropriate.

Figure 45:
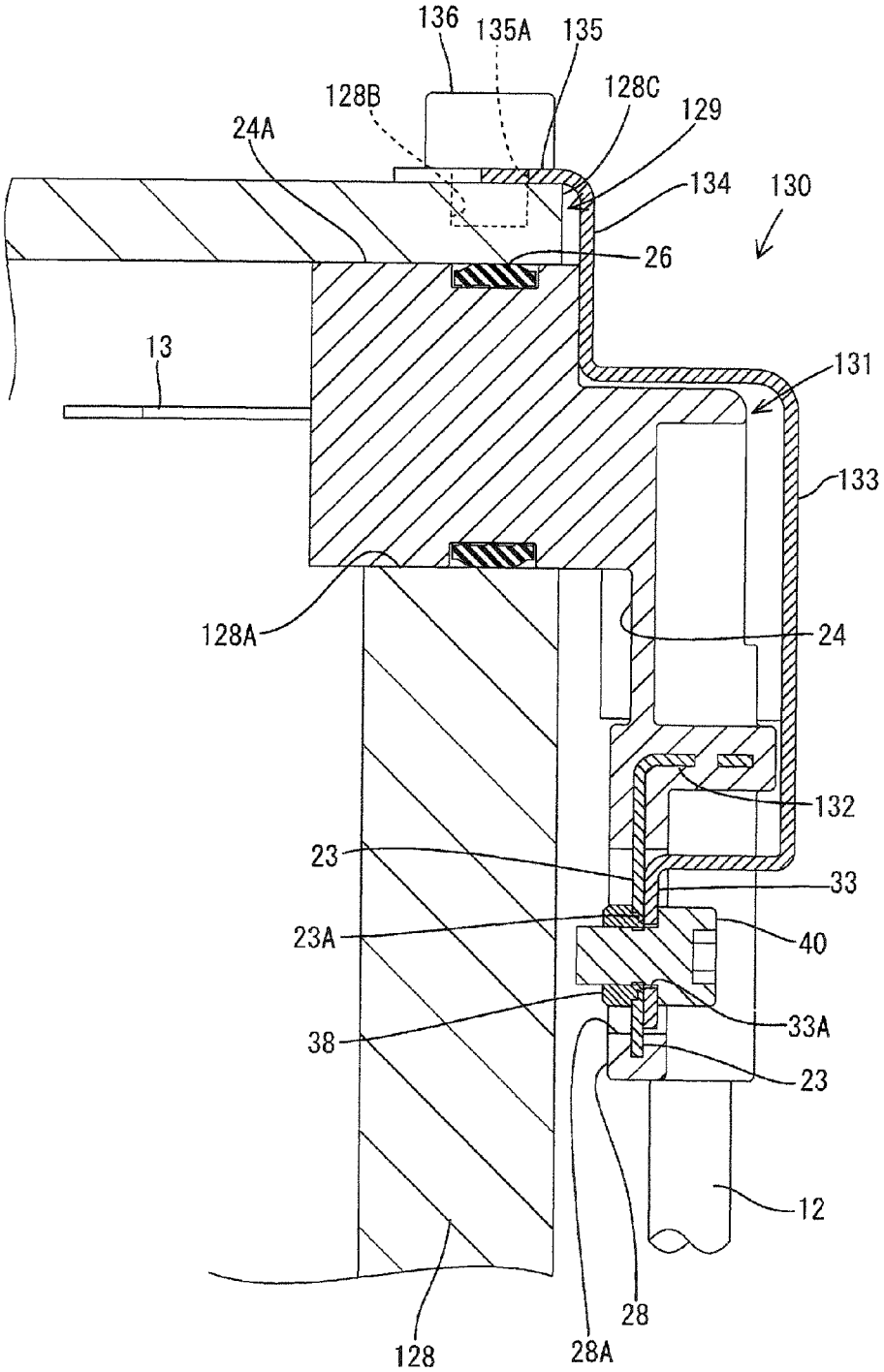
FIG. 45 is a section along G-G of FIG. 44 showing a state where the connector is mounted on a shield case.

As shown in FIG. 45, the connector 130 is mounted by fitting a fitting portion 24A into an opening 128A of a shield case 128 of a device (e.g. inverter device or the like of a hybrid vehicle or an electric vehicle). Since the shield case 128 is arranged before the connector 130 in this way, a component equivalent to the second shield shell 35 of the first embodiment is not provided.

The device is such that a device main body (not shown) is accommodated in the shield case 128 made of an electrical conductive material, and a mounted portion 129 on which the connector 130 is to be mounted is provided on the shield case 128.

The mounted portion 129 includes the opening 128A through which the fitting portion 24A of the connector 130 is to be inserted, and a clamping portion 128B including a screw hole having a screw groove formed on the inner periphery.

Figure 47:
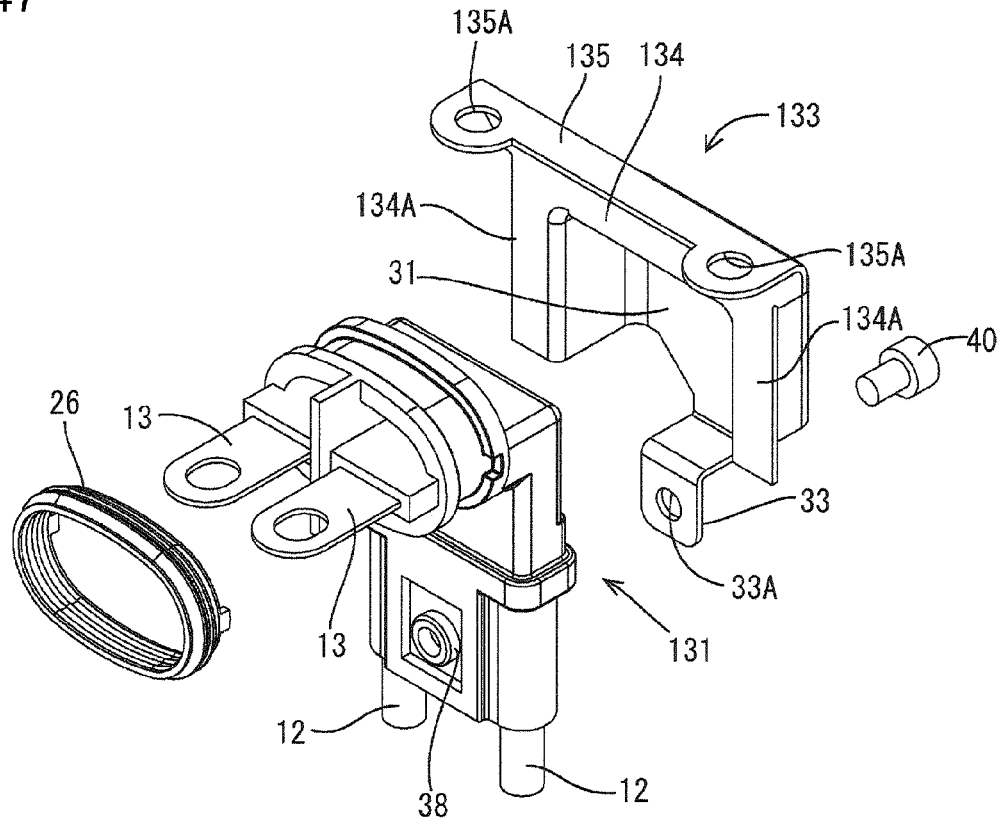
FIG. 47 is an exploded perspective view of the connector.

As shown in FIG. 47, the connector 130 includes a molded connector main body 131 and a first shield shell 133 for covering a back surface side of the molded connector main body 131.

Figure 46:
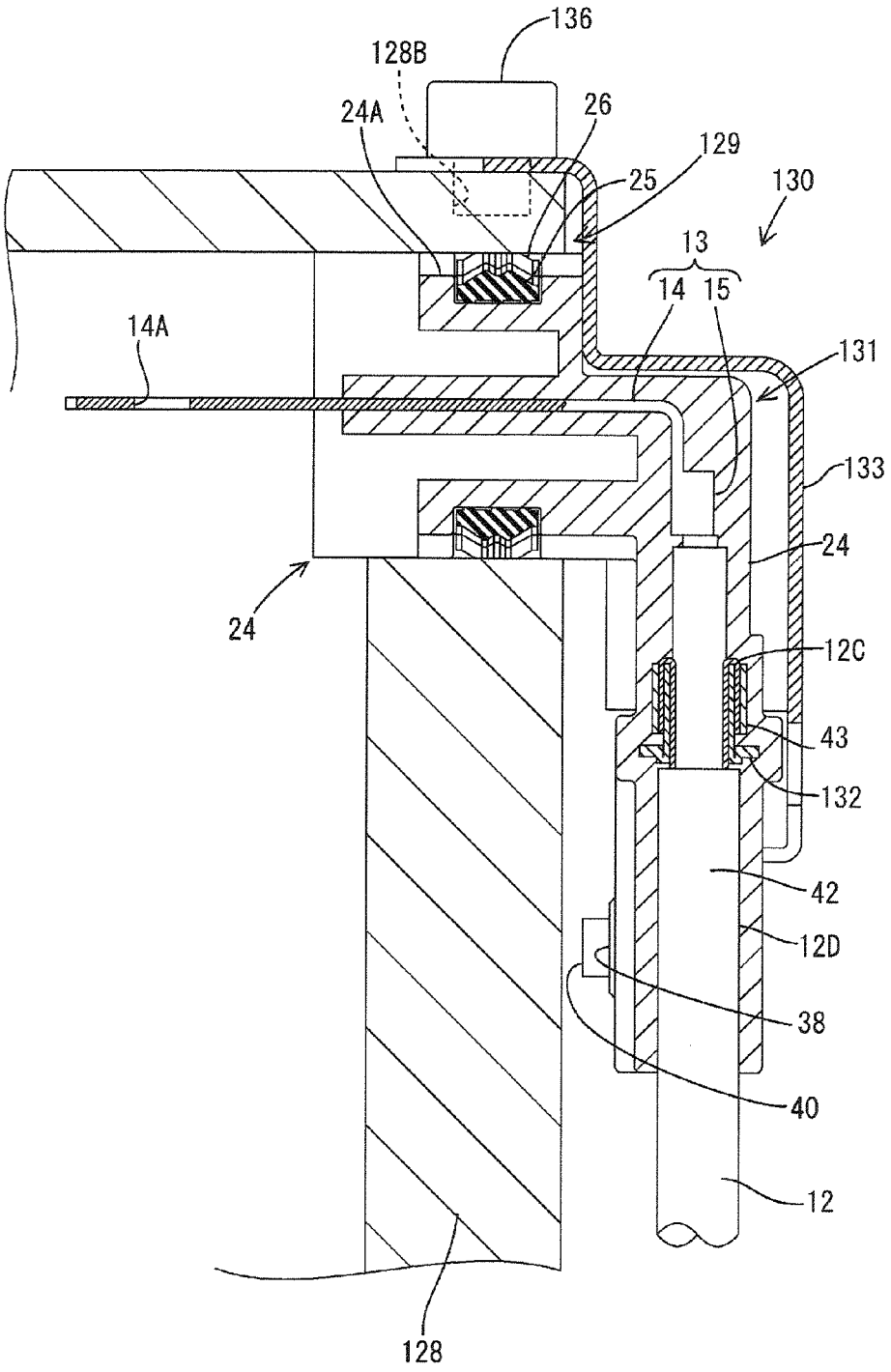
FIG. 46 is a section along H-H of FIG. 45 showing a state where the connector is mounted on the shield case.

As shown in FIG. 46, the molded connector main body 131 includes a plurality of (two in this embodiment) wires with terminal fittings 42, a wire shield connecting member 132 to be connected to shield layers 12C of wires 12, and a resin molded part 24 formed to include connected parts of the wires 12 and terminal fittings 13.

The wire shield connecting member 132 is made of metal and obtained by mounting the crimp nut 38 communicating with the third through hole 23A on the third fastened piece 23 of the wire shield connecting member 17 of the first embodiment.

As shown in FIG. 45, a rear end part of the crimp nut 38 is mounted by being press-fitted into a press-fit hole part of a through hole 23A (same as the third through hole 23A) of a fastened piece 23 (same as the third fastened piece 23) in the wire shield connecting member 132.

The first shield shell 133 is made of metal such as aluminum or aluminum alloy, to be mounted on the back surface side of the molded connector main body 131 (resin molded part 24) and composed of a shield portion 31 in the form of a recess in conformity with the shape of the molded connector main body 131, a protruding portion 134 protruding outwardly from the shield portion 31 and a fastened piece 33 (same as the first fastened piece 33) extending downwardly from the lower end of the shield portion 31 as shown in FIG. 47.

As shown in FIG. 45, the protruding portion 134 protrudes from the shield portion 31 in a direction along an outer surface 128C of the shield case 128, and an upper end part of this protruding portion 134 serves as a mounting portion 135 projecting forward.

Figure 43:
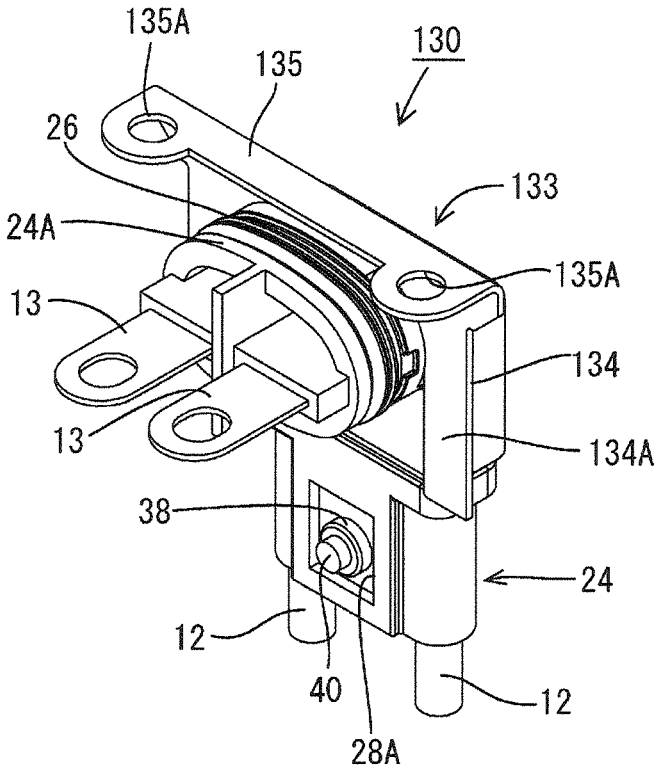
FIG. 43 is a perspective view showing a connector of a third embodiment.
Figure 44:
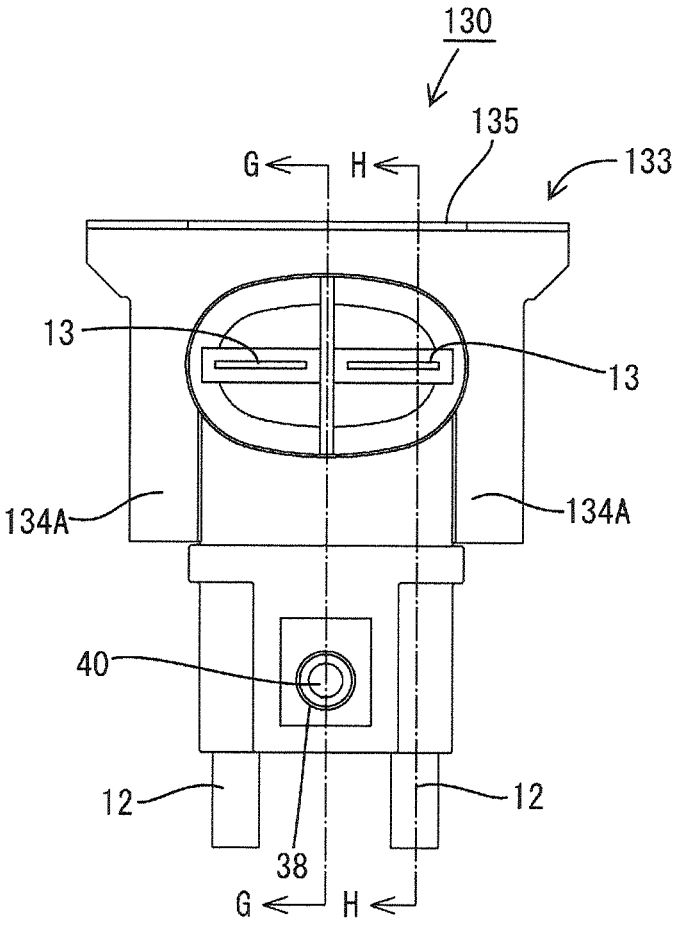
FIG. 44 is a front view showing the connector.

As shown in FIG. 43, circular mounting holes 135A are formed to penetrate through opposite end parts of the mounting portion 135. As shown in FIG. 45, clamps 136 are inserted through the mounting holes 135A of the mounting portion 135 and screwed into the clamping portions 128B of the shield case 128 with the fitting portion 24A fitted in the opening 128A and an end part of the shield case 128 arranged between the fitting portion 24A and the mounting portion 135, whereby the connector 130 is fixed to the shield case 128.

As shown in FIG. 43, a laterally protruding lateral protruding portion 134A of the protruding portion 134 is formed to extend longer downwardly than a corresponding part of the first embodiment.

As shown in FIG. 45, the fastened piece 33 (same as the first fastened piece 33) of the first shield shell 133 has a rectangular shape of such a size as to be accommodated into a fastening hole 28A of the resin molded part 24, and a circular through hole 33A (same as the first through hole 33A) is formed in a central part thereof.

Next, functions of this embodiment are described.

The terminal fittings 13 are crimped to the ends of the wires 12 to form the wires with the terminal fittings 42, the shield layers 12C folded back toward the insertion portions 20 of the wire shield connecting member 132 are fitted to cover the insertion portions 20, and the insertion portions 20 are swaged and crimped using the crimp fittings 43 mounted on the fitted shield layers 12C.

Subsequently, the wires with the terminal fittings 42 and the wire shield connecting member 132 are set in a molding die (not shown) to form the molded connector main body 131.

Subsequently, when the first shield shell 30 is mounted on the back surface side of the molded connector main body 131 as shown in FIG. 47, the through holes 23A, 33A are coaxially connected as shown in FIG. 45. Then, a shaft portion of a bolt 40 (fastening member) is inserted through the through holes 23A, 33A and the bolt 40 is fastened by being threadably engaged with the screw groove of the crimp nut 38, whereby the first shield shell 133 and the wire shield connecting member 132 are electrically connected.

This embodiment achieves the following effects.

Since the first shield shell 133 covers the resin molded part 24, a shielding function can be achieved by a simple configuration.

Further, in electrically connecting the shield layers 12C of the wires 12 and the first shield shell 133, the wire shield connecting member 132 to be connected to the shield layers 12C is used and the first shield shell 133 and the wire shield connecting member 132 are fastened by the bolt 40 (fastening member) inserted through the respective through holes 33A, 23A thereof. Thus, the shields can be reliably connected by a simple configuration.

Further, for the shield case 128 side, a part of the shield case 128 side of the connector 130 is shielded using the configuration of the shield case 128 without using the second shield shell 35 as in the first embodiment. Thus, the number of components can be reduced since the second shield shell 35 is not used.

The first shield shell 133 and the wire shield connecting member 132 respectively include the fastened pieces 33, 23 (fastened portions) to be placed one next to each other on a part not including the resin molding and formed with the through holes 33A, 23A.

Since the respective fastened pieces 33, 23 (fastened portions) arranged on the part not including resin molding can be fastened by the bolt 40 (fastening member) in this way, a projecting distance of the bolt 40 in a thickness direction of the connector 130 can be reduced and the thickness of the connector 130 can be reduced.

The respective fastened pieces 33, 23 (fastened portions) are fastening pieces 33, 23 extending from the first shield shell 133 and the wire shield connecting member 132.

Since the fastened portions are the fastening pieces 33, 23 in this way, the configuration of the fastened portions can be simplified.

There are a plurality of wires 12, the wire shield connecting member 132 includes the fastening pieces 33, 23 (fastened portions) to which the bolt 40 (fastening member) is to be fastened and a plurality of insertion portions 20 into which the plurality of wires 12 are to be inserted and which are to be connected to the shield layers 12C, and the plurality of insertion portions 20 and the fastening pieces 33, 23 (fastened portions) are connected.

In this way, a configuration for connecting the shield layers 12C of the wires 12 and the first shield shell 133 can be simplified.

The present invention is not limited to the above described and illustrated embodiments. For example, the following embodiments are also included in the technical scope of the present invention.

Although the shield layers 12C are connected to the wire shield connecting member 17 by crimping the shield layers 12C using the crimp fittings 43 in the first to third embodiments, there is no limitation to this. For example, welding or brazing or soldering may be performed in addition to or instead of crimping.

Although two wires 12 are provided in the above embodiments, the number of the wires 12 may be one, three or more.

The position of fastening by the bolt 40 (fastening member) is not limited to the lower end part or the upper end part of the back surface side of the connector as in the above embodiments and may be another position.

Although the fastening by the bolt 40 is performed using the crimp nut 38 mounted on the second shield shell 35 or the wire shield connecting member 132 in the first and third embodiments, there is no limitation to this. A nut which is not to be press-fitted into a mating side of the bolt 40 may be used, or a nut portion integral to the second shield shell and including a screw groove may be formed for fastening. Further, although the crimp nut 38 is mounted by being press-fitted in the first and third embodiments, welding or another known method may be employed without being limited to press-fitting.

The invention claimed is:

1. A connector, comprising:

a wire with a shield layer;

an L-shaped terminal fitting to be mounted on an end of the wire;

a resin molded part provided to include a connected part of the wire and the terminal fitting;

a first shield shell configured to cover a predetermined part of the resin molded part and including a through hole;

a wire shield connecting member to be connected to the shield layer of the wire and including a through hole; and a fastening member configured to fasten the first shield shell and the wire shield connecting member by being inserted through the respective through holes of the first shield shell and the wire shield connecting member and electrically connect the first shield shell and the wire shield connecting member.

2. The connector of claim 1, wherein the first shield shell and the wire shield connecting member are respectively placed one next to each other on a part not including the resin molding and include fastened portions formed with the respective through holes.

3. The connector of claim 2, wherein the respective fastened portions are fastening pieces extending from the first shield shell and the wire shield connecting member.

4. The connector of claim 3, wherein the fastening pieces extend toward a back surface side of the resin molded part.

5. The connector of claim 1, further comprising a second shield shell configured to cover a part of the resin molded part not covered by the first shield shell and including a through hole;

wherein the fastening member fastens the first shield shell, the second shield shell and the wire shield connecting member by being inserted through the respective through holes of the first shield shell, the second shield shell and the wire shield connecting member and electrically connects the first shield shell, the second shield shell and the wire shield connecting member.

6. The connector of claim 5, wherein the second shield shell includes a fastened portion to be arranged on a part not including the resin molding and the fastened portion is a fastening piece extending from the second shield shell.

7. The connector of claim 5, wherein the first shield shell covers a back surface side of the resin molding, the second shield shell covers a front surface side of the resin molding, and fastening by the fastening member is performed with the wire shield connecting member sandwiched between the first and second shield shells.

8. The connector of claim 5, wherein the second shield shell has a tubular shape surrounding a part of the resin molded part from which the wire extends, and the first shield shell covers a back surface side of the resin molded part not covered by the second shield shell.

9. The connector of claim 2, wherein there are a plurality of wires, the wire shield connecting member includes a fastened portion to which the fastening member is to be fastened and a plurality of insertion portions through which the plurality of wires are to be inserted and which are to be connected to the shield layers, and the plurality of insertion portions and the fastened portion are connected.

* * * * *